United States Patent [19]

Skwirut et al.

[11] Patent Number: 4,871,944

[45] **Date of Patent: * Oct. 3, 1989**

[54] COMPACT LIGHTING UNIT HAVING A CONVOLUTED FLUORESCENT LAMP WITH INTEGRAL MERCURY-VAPOR PRESSURE-REGULATING MEANS, AND METHOD OF PHOSPHOR-COATING THE CONVOLUTED ENVELOPE FOR SUCH A LAMP

[75] Inventors: Henry Skwirut, Verona; Robert C. Young, Nutley, both of N.J.

[73] Assignee: North American Philips Corp., New York, N.Y.

[ * ] Notice: The portion of the term of this patent subsequent to Nov. 10, 1998 has been disclaimed.

[21] Appl. No.: 216,216

[22] Filed: Dec. 12, 1980

Related U.S. Application Data

[63] Continuation-in-part of Ser. No. 11,832, Feb. 13, 1979, Pat. No. 4,300,073.

[51] Int. Cl.[4] ..... H01J 7/44

[52] U.S. Cl. ..... 315/56; 315/46; 315/50; 315/108; 313/450; 313/493

[58] Field of Search ..... 313/220, 490, 493, 491; 315/108, 46, 51, 52, 56

[56] References Cited

U.S. PATENT DOCUMENTS

| | | | |
|---|---|---|---|
| 3,331,977 | 7/1967 | Wainio | 313/34 |
| 3,534,212 | 10/1970 | Evans | 313/174 |
| 3,548,241 | 12/1970 | Rasch et al. | 313/493 X |
| 4,199,708 | 4/1980 | Lauwerijssen et al. | 313/493 |
| 4,272,703 | 6/1981 | Eckberg | 313/493 |
| 4,300,073 | 11/1981 | Skwirut et al. | 315/53 |
| 4,337,414 | 6/1982 | Young | 313/493 |

FOREIGN PATENT DOCUMENTS

| | | | |
|---|---|---|---|
| 0642888 | 6/1964 | Canada | 313/109 |
| 2752593 | 5/1979 | Fed. Rep. of Germany | 313/220 |
| 4928295 | 12/1977 | Japan | 313/493 |
| 55-83147 | 6/1980 | Japan | 313/493 |
| 55-137659 | 10/1980 | Japan | 313/493 |
| 54-144647 | 11/1980 | Japan | 313/493 |
| 2033653 | 5/1980 | United Kingdom | 313/493 |
| 2040554 | 8/1980 | United Kingdom | 313/490 |

*Primary Examiner*—David K. Moore
*Attorney, Agent, or Firm*—Emmanuel J. Lobato

[57] ABSTRACT

A fluorescent lamp having a multi-U-bent tubular envelope of convoluted configuration is combined with circuit means, a translucent protective cover and a base module to provide an efficient lamp unit of high brightness and long life that is compact enough to be used as a replacement for incandescent lamps in fixtures designed for residential and commerical lighting installations. Various spatial arrangements for including the ballast and starter components of the energizing circuit as integral parts of the compact lamp unit, despite the stringent space limitations, and also venting the cover and base module to provide convection cooling of the convoluted fluorescent lamp and the other electrical components are also disclosed. Tubulations provided on U-bent portions of the lamp envelope serve as phosphor-drainage means during lamp manufacture and are subsequently tipped off to form mercury-condensation chambers within the finished lamp that regulate the mercury-vapor pressure during lamp operation. The vapor-pressure regulating tubulations are so located relative to the vent openings in the lamp unit that they are exposed in the cool air which circulates through the lamp unit when the latter is energized and in use.

22 Claims, 13 Drawing Sheets

COMPACT LIGHTING UNIT HAVING A CONVOLUTED FLUORESCENT LAMP WITH INTEGRAL MERCURY-VAPOR PRESSURE-REGULATING MEANS, AND METHOD OF PHOSPHOR-COATING THE CONVOLUTED ENVELOPE FOR SUCH A LAMP

CROSS-REFERENCE TO RELATED APPLICATION

This application is a continuation-in-part of application Ser. No. 11,832 filed Feb. 13, 1979 (now U.S. Pat. No. 4,300,073).

BACKGROUND OF THE INVENTION

This invention relates to electric lamps and has particular reference to a compact fluorescent lamp unit that is adapted for use as a direct replacement for incandescent type lamps in lighting fixtures employed for residential and commercial illumination, and to a convoluted fluorescent lamp component for such a compact lamp unit.

Fluorescent lamp units having integral circuit and base components which permit the unit to be screwed into and operated in the sockets of lighting fixtures that are designed for incandescent type lamps are generally well known in the art. A lamp unit of this type having a cylindrical envelope that contains concentric annular partitions (or which is made from tubing that is bent upon itself to provide a U-shaped bulb) is disclosed in U.S. Pat. No. 3,551,736 granted Dec. 29, 1970 to Doehner. As disclosed in FIG. 5 and at lines 24–30, column 2 of this patent, if a tubular U-shaped bulb is used as the envelope it may be additionally twisted into spiral shape or redoubled on itself to provide a generally M-shaped envelope. A lamp assembly having adapter means which accommodates a conventional straight tubular fluorescent lamp and contains a ballast transformer that is part of a threaded base member which permits the lamp assembly to be screwed into an incandescent lamp socket is disclosed in U.S. Pat. No. 3,815,080 granted June 4, 1974 to F. Summa.

According to a more recent development, a screwing type fluorescent lamp bulb is provided with integral ballast means that is disposed in telescoped relationship with an envelope that defines a discharge space of flat toroidal shape of similar configuration. A lamp unit of this type is disclosed in U.S. Pat. No. 3,953,761 granted Apr. 27, 1976 to T. Giudice. Another fluorescent lamp assembly of this general type having a tapered cylindrical envelope of molded glass that defines a helical-shaped discharge channel and accommodates a ballast component is described in U.S. Pat. No. 3,899,712 issued Aug. 12, 1975 to H. Witting.

An electrodeless fluorescent lamp unit of the screw-in type that is energized by high frequency energy produced by a self-contained radio-frequency oscillator and ferrite core is disclosed in U.S. Pat. No. 3,521,120 granted July 21, 1970 to J. M. Anderson.

Electric discharge lamps having tubular envelopes which are bent into various shapes to provide concentrated sources of light are also generally well known in the art. A sodium-vapor discharge lamp of double-ended construction having an envelope formed from a vitreous tube that is folded or bent upon itself twice to provide three straight segments that are disposed in triangular-spaced relationship is disclosed in British Patent No. 854,745 published Nov. 23, 1960 (FIGS. 3 and 4 embodiment). A luminous discharge tube designed for advertising and display purposes (or for use as a beacon light) and having thimble-like electrodes and an envelope which is formed from glass tubing bent upon itself eleven times to provide a corresponding number of conjoined U-shaped sections is disclosed in U.S. Pat. No. 1,898,615 granted Feb. 21, 1933 to Byrnes. A plug-in type discharge lamp having a tubular envelope that is bent upon itself three times to provide a multi-segment envelope which is disposed within a heat-conserving double-walled enclosure is disclosed in U.S. Pat. Nos. 2,001,511 and 2,200,940 granted to Uyterhoeven et al.

Fluorescent lamps having "three-dimensional" type envelopes that are formed by coupling several arcuate lamp components together or interconnecting several straight tubular bulbs in "bundled" configuration are also known in the art and are disclosed in U.S. Pat. No. 2,652,483 (Laidig et al.) and U.S. Pat. No. 3,501,662 (Plagge), respectively.

The use of an exposed tubulation on the envelope of a fluorescent lamp which provides a "cool" chamber or region within the lamp that controls the mercury-vapor pressure during operation and thus prevents loss of light output due to excessively high vapor pressure is per se known in the art. Fluorescent lamps having such tubulations are disclosed in U.S. Pat. Nos. 3,331,977 (Wainio) and 3,511,405 (Plagge).

SUMMARY OF THE INVENTION

While it has long been realized in the prior art that the physical size of a fluorescent lamp could be decreased to provide a brighter light source by using partitioned or bent multi-segment tubular envelopes, lamp units employing such concepts were impractical from a commercial standpoint since they required special electrode and seal structures and/or envelopes that were very difficult and expensive to make on a mass production basis. In many cases the envelopes were also so configured that the physical dimensions of the lamp unit which contained integral circuit components and was fitted with a screw-in type base component were too large to permit the lamp unit to be used in lighting fixtures and sockets designed for incandescent lamps. Another serious shortcoming of the prior art screw-in type fluorescent lamp units was that, when they were made small enough to fit into incandescent lamp fixtures and sockets, they were unable to generate a sufficient amount of light to provide illumination comparable to that obtained without an incandescent lamp, or to produce such illumination without radio-frequency interference and at a level of efficiency that would justify the added initial expense of such lamp units.

Bending the tubular envelopes of fluorescent lamps into convoluted form to reduce the physical size of the lamp also created a manufacturing problem in that it was very difficult to coat the inner surfaces of such convoluted envelopes with a uniform layer of phosphor. Due to the compact size of such fluorescent lamps, proper control of the mercury-vapor pressure within the operating lamp was also difficult to achieve, especially when the lamp was placed within a protective housing and/or operated at high power loadings to increase its light output to a desired level.

The foregoing manufacturing problems and commercial disadvantages are overcome in accordance with the present invention by providing a screw-in type lamp unit which contains a fluorescent lamp that has a tubular envelope of tridimensional convoluted configuration. The envelope is of multi-U-bent construction and so shaped that it not only permits conventional stem and electrode components to be employed but physically accommodates circuit means and a threaded base in such a manner that the resulting lamp unit is small enough to be used in sockets and lighting fixtures designed for incandescent type lamps and produces light of an intensity comparable to that obtained from such incandescent lamps. The envelope configuration is also of such character that it provided an integral "cooling" chamber for mercury-vapor pressure regulation and means for avoiding phosphor-coating difficulties.

Since the fluorescent lamp component employed in the new lamp unit is basically a conventional straight tubular fluorescent lamp that has been bent into convoluted form, it employs the same components and basic technology used to manufacture standard type fluorescent lamps and thus can be made at a reasonable cost and will have the excellent light output and efficacy, as well as the long useful life, exhibited by conventional fluorescent lamps now being marketed and in use. The improved fluorescent lamp unit provided by the present invention accordingly has the requisite physical compactness, light output, and high level of quality and performance needed to make it a practical and energy-conserving substitute for incandescent type lamps.

In accordance with one embodiment, the convoluted fluorescent lamp is of triple-U-bent construction and the tubular leg segments of the U-shaped sections of the envelope are arranged in spaced quadrangular columnar relationship to provide a central opening that accommodates an elongated choke ballast and thus reduces the size of the lamp unit without materially decreasing its light output. In another embodiment, the ballast and starter components are located within the base structure to provide a fluorescent lamp unit that is more elongated but of smaller width dimension. Integral means for facilitating the phosphor-coating operation and subsequently defining a vapor-pressure regulating "cool" chamber for condensed mercury within the finished lamp is provided and comprises a tubulation that extends outwardly from the U-bent portion (or portions) of the convoluted envelope to permit rapid drainage of the phosphor paint, and is subsequently sealed off to form a "cooling" tip or appendage.

Experimental fluorescent lamp units embodying the present invention and containing integral ballast and starter components which permit the units to be operated from conventional 120 volt alternating-current power outlets have outputs in the order of 1,000 lumens and system efficiencies of approximately 40 lumens per watt and are compact enough to be used in table lamps and similar lighting fixtures that are employed in homes and offices and were specifically designed for incandescent type lamps.

Another important feature of the present invention is the use of a protective cover or housing which diffuses the intense light from the convoluted fluorescent lamp in a pleasing manner and has vent openings that cooperate with similar openings in the base structure to permit air to circulate through the lamp unit past the vapor-pressure regulating appendage of the envelope during operation and thus dissipate heat generated by the lamp and circuit components. The resulting convection cooling of the operating lamp unit and envelope appendage is very advantageous since it prevents the fluorescent lamp and integral circuit components from becoming overheated during operation and thus becoming less efficient, despite the compactness of the lamp unit. Such cooling also provides the option of using convoluted fluorescent lamp components that have higher light outputs, in the order of 2,000 lumens for example.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be advantageously employed in various kinds of lamp units and assemblies that are suited by virtue of their small physical size and high brightness for lighting homes or offices, it is particularly adapted for use in conjunction with lamp units that have screw-in or bayonet type bases and employ low-pressure type discharge lamps such as fluorescent lamps as the light source and it has, accordingly, been so illustrated and will be so described.

Figure 1:
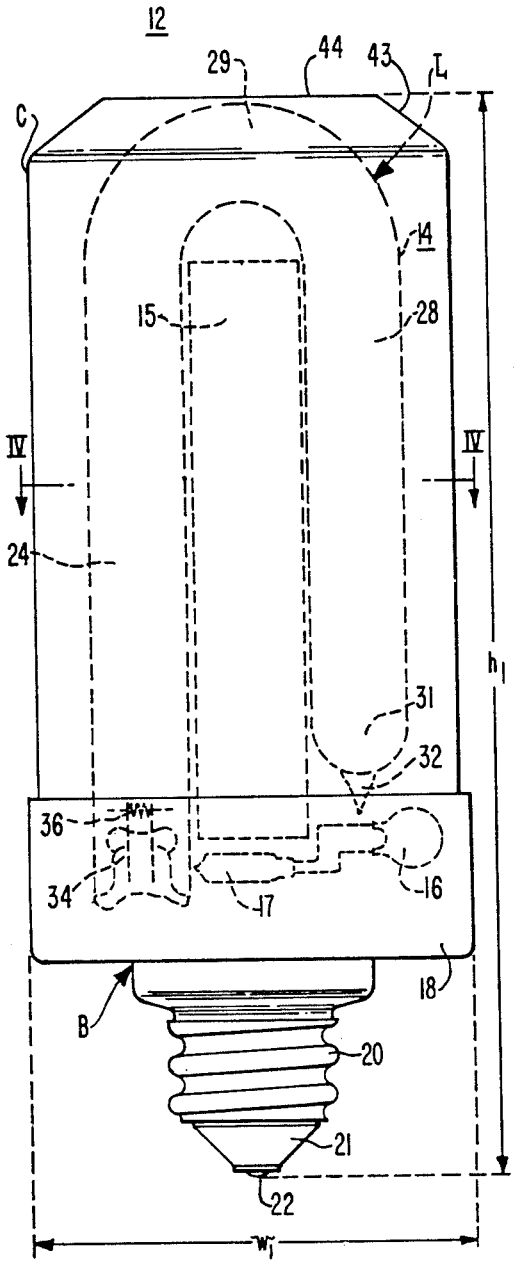
FIG. 1 is a side elevational view of a compact fluorescent lamp unit that embodies the invention, the convoluted lamp and circuit components being shown in phantom outline to indicate their locations within the unit.

A compact fluorescent lamp unit 12 embodying the invention is shown in FIG. 1 and consists of three basic components—namely, a fluorescent lamp L having a tubular envelope 14 of convoluted configuration which provides a concentrated light source of high efficacy and brightness (as hereinafter explained), a light-transmitting housing such as a cover C that protectively encloses the fluorescent lamp L, and a base structure B that is coupled to the sealed ends of the lamp envelope 14 and holds the fluorescent lamp L in assembled relationship with the cover C and the various integral components of a circuit which permits the lamp unit 12 to be operated on an alternating-current power source.

As will be noted, in this embodiment the circuit means comprises an elongated ballast component 15 (that is located in the space between the U-bent sections of the convoluted fluorescent lamp envelope 14) and a conventional condenser 16 and starter 17 that are connected with the ballast 15 and the lamp electrodes in the usual manner. The base structure B has a cup-shaped portion 18 that accommodates and contains the sealed ends of the fluorescent lamp envelope 14 as well as the condenser 16 and starter 17. The base structure B is terminated by a suitable electrical connector component, preferably a threaded base member 20 having the usual insulator 21 and end contact 22. The threaded base member 20 is of a type that will fit the threaded sockets designed for incandescent type lamps so that the single-ended fluorescent lamp unit 12 can be screwed into and be operated in such sockets.

Figure 2:
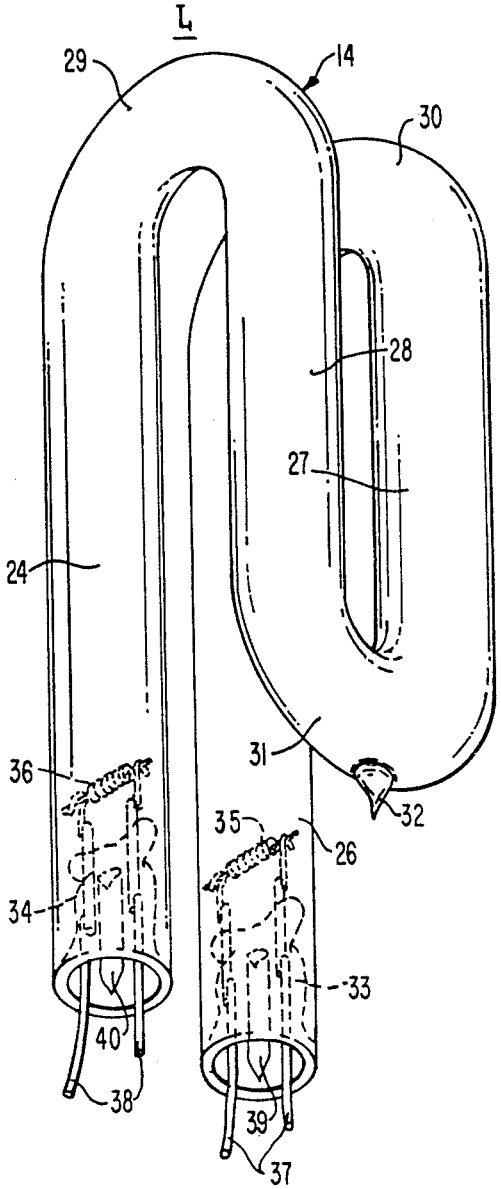
FIG. 2 is a pictorial view of the triple-U-bent fluorescent lamp component employed in the lamp unit shown in FIG. 1.

As shown more particularly in FIG. 2, the envelope 14 of the fluorescent lamp L comprises a vitreous tube that is bent in a manner such that it has four substantially straight leg segments 24, 26, 27, 28 that extend in the same direction and are joined by three U-bent segments 29, 30, 31. The U-bent segments are of such curvature and so oriented that the tubular leg segments are disposed in quadrangular columnar array and spaced from one another. The leg segments and U-bent segments accordingly form three conjoined U-shaped envelope sections that are located in three different planes and define a single discharge channel of serpentine configuration that is terminated by leg segments 24, 26. The envelope 14 is, accordingly, of triple-U-bent tridimensional form and very compact.

As shown, the U-bent segment 31 which constitutes the medial portion of the convoluted envelope 14 and is adjacent to the terminal leg segments 24, 26 has a tipped-off segment 32 of a glass tubulation that is used to drain phosphor paint from the envelope during the phosphor-coating operation and ensure that the medial U-bent section is coated with a uniform layer of phosphor material. Insofar as the compact fluorescent lamp L operates at rather high loading, the tipped-off segment 32 affords an additional advantage in the finished lamp pursuant to the invention since it defines a cavity inside the envelope 14 that serves as a "cool spot" and thus functions as a reservoir for-condensed mercury that controls the mercury vapor pressure during lamp operation. The leg segments 24, 26 extend beyond the medial U-bent segment 31 and are hermetically sealed by conventional stem components 33, 34 which include the usual tungsten-coil electrodes 35, 36 that are coated with suitable electron-emission material and connected to suitable conductors such as paired lead-in wires 37, 38 that extend through the respective stems and beyond the sealed ends of the envelope 14. Each of the stems have a sealed-off remnant 39, 40 of an exhaust tubulation which permits the convoluted phosphor-coated envelope 14 to be evacuated and then charged with a suitable fill gas and dosed with mercury in accordance with standard lamp-making practice.

If desired, non-tubulated type stems can be used and the evacuation, gas-filling and mercury-dosing operations can be done through the tubulation which extends from U-bent segment 31.

As will be noted in FIGS. 1 and 2, the sealed legs 24, 26 of the envelope 14 extend beyond the medial U-bent segment 31 and are disposed in side-by-side paired relationship on the same side of such segment. These are important structural features since they provide an unobstructed space or central opening that extends upwardly from the base structure B into the triple-U-bent envelope 14 between the leg segments 24, 26, 27, 28, as well as a smaller space below U-bend 31 adjacent the sealed ends of the legs 24, 26. As illustrated in FIG. 1, the provision of such spaces permits the elongated ballast component 15 to be placed in telescoped nestled relationship with the convoluted lamp envelope 14 and provides room for recessing the condenser 16 and starter 17 within the base structure B adjacent the sealed ends and beneath the medial U-bent segment of the envelope. The circuit components thus constitute integral parts of the compact lamp unit 12 and are located within its physical confines.

Since the tubular leg segments 24, 26, 27, 28 of the triple-U-bent envelope 14 extend in the same direction and are disposed substantially parallel to one another in quadrangular and columnar-spaced array, the overall configuration of the fluorescent lamp L is such that it is generally cubical or tetrahedral in character. When the lamp L is energized it thus constitutes a three-dimensional source of light which, while very compact, still has a single discharge channel that is about four times the height of the envelope 14 and thus permits the lamp to be operated efficiently at a voltage and current compatible with the electrical power supplied to homes and offices.

As indicated in FIG. 1, the width dimension $w_1$ of the lamp unit 12 is governed by the diameter of the circular cup-shaped portion 18 of the base structure B required to accommodate the cylindrical protective cover C and is thus only slightly larger than the width of the convoluted lamp L. The height dimension $h_1$ of the lamp unit 12 is determined by the combined lengths of the convoluted lamp L and base structure B. Due to the triple-U-bent configuration of the lamp L and the interfitting of the envelope 14 with the circuit components and cup-shaped portion 18 of the base structure B, the height dimension $h_1$ of the lamp unit 12 is drastically reduced.

While the convoluted lamp envelope 14 can be made by joining three U-bent sections of vitreous tubing together, it is preferably formed from a single piece of lead glass tubing of the kind used for conventional fluorescent lamp bulbs. The glass tubing is bent at the proper points to form the U-bends and is subsequently coated with phosphor and provided with stem assemblies, etc., in the usual manner. The envelope 14 is charged with a suitable ionizable medium such as a fill gas and a measured dose of mercury that are introduced into the envelope through the exhaust tubes of the stems 33, 34 before they are tipped-off and sealed. A suitable fill gas is argon at a pressure below about 10 Torr, and preferably about 3 Torr. The mercury dosage will vary according to the physical size of the lamp L and the power loading at which it is operated but is sufficient to provide mercury vapor at a partial pressure of from about 6 to 10 millitorr when the lamp is operated at its rated wattage, and maintain, the mercury vapor pressure at this level within the lamp throughout its useful life.

While any suitable phosphor (or mixture of phosphors) can be used to form the luminescent coating deposited on the inner surface of the convoluted tubular envelope 14, in lighting applications where optimum visual clarity and color rendition of the illuminated objects or area are required, phosphor coatings which contain a blend of three phosphors that emit visible radiations in three different selected regions of the spectrum (specifically, the wavelength regions of about 450 nm, 540 nm and 610 nm) are desirably employed to provide a so-called "prime color" fluorescent lamp L, pursuant to the teachings of the W. A. Thornton in the article entitled "Luminosity and Color-Rendering Capability of White Light", *Journal of the Optical Society of America,* Vol. 61, No. 9 (September 1971), pages 1155–1163. As a specific example, a suitable phosphor blend for a triple-U-bent fluorescent lamp having such an enhanced light output contains manganese-activated zinc silicate phosphor, europium-activated strontium chlorophosphate phosphor, and europium-activated yttrium oxide phosphor—all of which are well known to those skilled in the art. Alternatively, the envelope 14 can be coated with "Cool White" or "Warm White" halophosphate type phosphors (or any other kind of phosphor or phosphor mixtures) employed in conventional fluorescent lamps.

Figure 3:
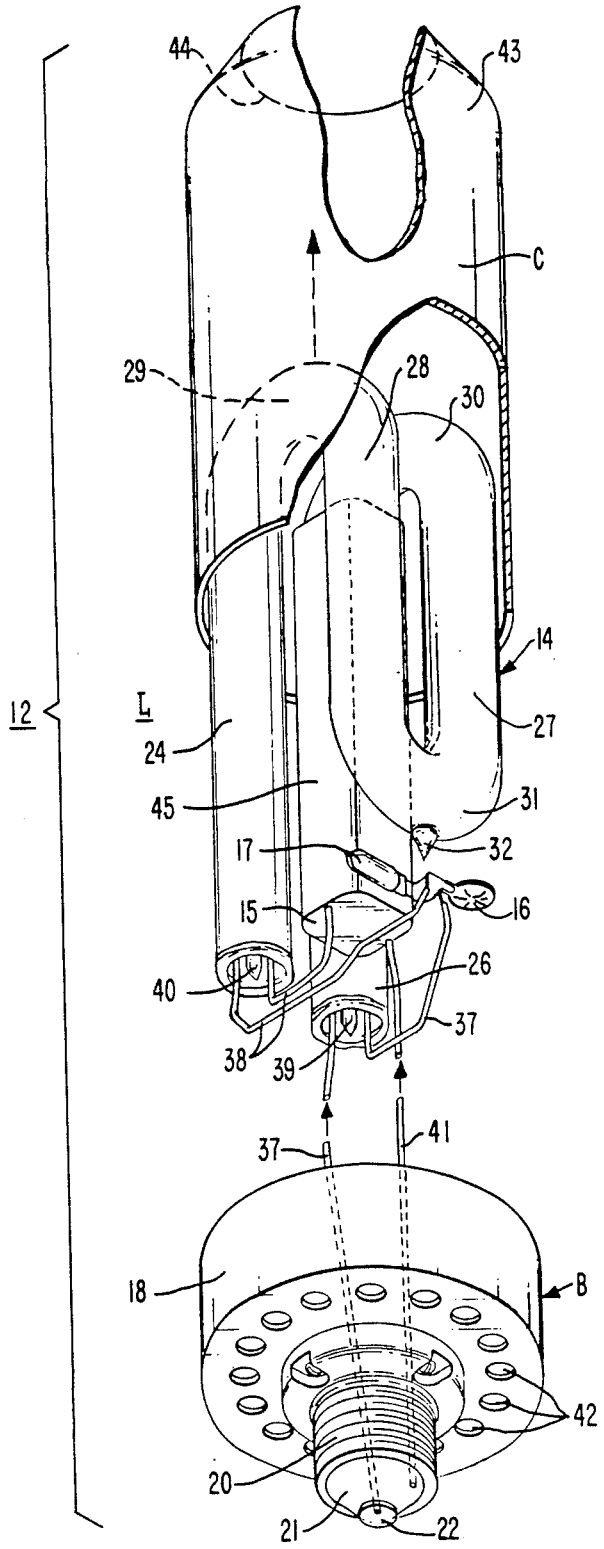
FIG. 3 is an exploded perspective view of the fluorescent lamp unit shown in FIG. 1.
Figure 4:
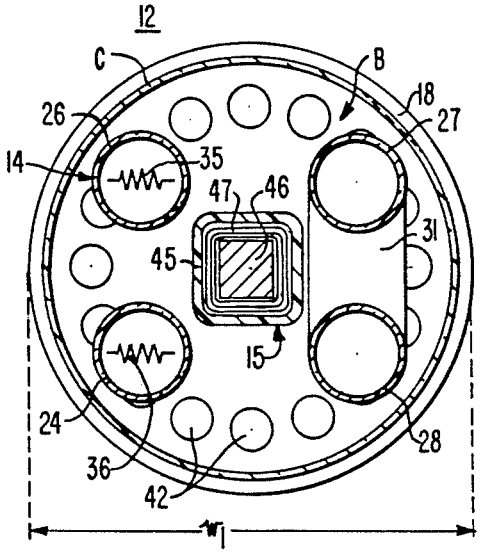
FIG. 4 is a cross-sectional view through the lamp unit along line IV—IV of FIG. 1.

As shown more particularly in FIGS. 3 and 4, the compact fluorescent lamp unit 12 is fabricated by first inserting the elongated ballast component 15 in nestled position within the leg segments 24, 26, 27 and 28 of the convoluted envelope 14 and then connecting the ballast, condenser 16 and starter component 17 to the insulated lead wires 37, 38 and socket contacts in the manner illustrated in FIG. 3 (a separate insulated conductor 41 being employed to connect one side of the ballast 15 with the shell contact of the screw base 20). The end contact 22 of the base 20 is connected by one of the lead wires 37 directly to one of the lamp electrodes so that the ballast 15 is connected in series with the electrodes. The condenser 16 and starter 17 are connected in the usual manner to start the fluorescent lamp L in preheat fashion when the lamp unit 12 is connected to an alternating-current power source.

The convoluted fluorescent lamp L and its attached circuit components are then mounted in upstanding position within the cup-shaped end portion 18 of the base structure B, secured to the latter by suitable means (not shown) such as cement or an interlocking support member that couples the sealed legs 24, 26 of the envelope 14 to the base structure, and the conductors 37 and 41 are fastened to the base contacts by soldering or the like. The resulting subassembly (consisting of the convoluted fluorescent lamp L, connected circuit components and coupled base structure B) is then inserted into the protective cover C until the rim of the cover is firmly seated within and frictionally held by (or otherwise secured to) the cup-shaped end 18 of the base structure B.

Since the convoluted fluorescent lamp L and integral circuit components are confined within a very small space, care must be taken to prevent the operating lamp unit 12 from overheating since this would cause the lamp efficacy to decrease and could create a potential safety hazard. These problems are avoided in accordance with the invention by providing a plurality of vent apertures 42 (see FIGS. 3 and 4) that are spaced along the bottom wall of the cup-shaped portion 18 of the base structure B, and by utilizing a protective cover C which consists of a cylindrical sleeve having a tapered end 43 with a central opening 44, which opening (in conjunction with the vent apertures 42 in the base structure) permits the free circulation of air through the operating lamp unit 12 in chimney-like fashion. The resulting "convection cooling effect" dissipates heat generated by the fluorescent lamp L and ballast component 15 and ensures that they do not become too hot.

As shown in FIG. 4, the medial U-bent segment 31 of the convoluted envelope 14 is located almost directly above the vent apertures 42 in the cup-shaped portion 18 of the base structure B. The circulating current of cool air thus flows past the tipped-off segment 32 which depends downwardly from U-bent envelope segment 31 and inherently provides the proper operating conditions for the mercury-condensation cavity or chamber defined by the seal tip 32.

In order to minimize light losses, the ballast component 15 is desirably covered by a sheath 45 (shown in FIGS. 3 and 4) of suitable white or light-colored insulating material such as a heat-resistant tape or plastic. Of course, a metal case can also be used as the light-reflective sheath instead of the tape or plastic, providing due care is taken to insulate the ballast from the metal case. As will be noted in FIG. 4, the ballast component 15 desirably comprises a so-called "finger" type choke ballast that has an iron core 46 which is overwound with insulated wire 47 and encased in the light-reflective sheath 45.

The cup-shaped support portion 18 of the base structure B can be formed from suitable metal such as aluminum, providing the conductors which connect the circuit components to the lamp electrodes are properly insulated to prevent short circuits. The screw-in base member 20 is preferably of the "medium" screw type and can be secured to the bottom wall of the cup-shaped support 18 with suitable fasteners, or it can be formed as an integral part of the cup-shaped support 18 by stamping the cup-shaped member and base shell from a single piece of metal (or by molding it from suitable plastic).

The protective cover C can be made of glass, heat-resistant plastic or other suitable transparent or translucent material that will not absorb the light rays generated by the fluorescent lamp L. If transparent material is used, it may be made translucent by a white light-diffusing coating (or other means) to reduce glare from the bright surface of the triple-U-bent lamp L and to provide a more uniform and pleasing lighted appearance.

The starter component 17 is of the conventional "glow lamp" type that is permanently wired in place. However, it could be made in the form of a fuse-like component and mounted within the base structure B in such a manner that it may be readily removed and replaced as necessary by a twist-lock action. The condenser 16 is of the miniature wafer type and is connected in the circuit in such a fashion that it eliminates or minimizes radio interference during lamp starting.

ALTERNATIVE COMPACT LAMP UNIT EMBODIMENT (FIGS. 5–7)

Figure 5:
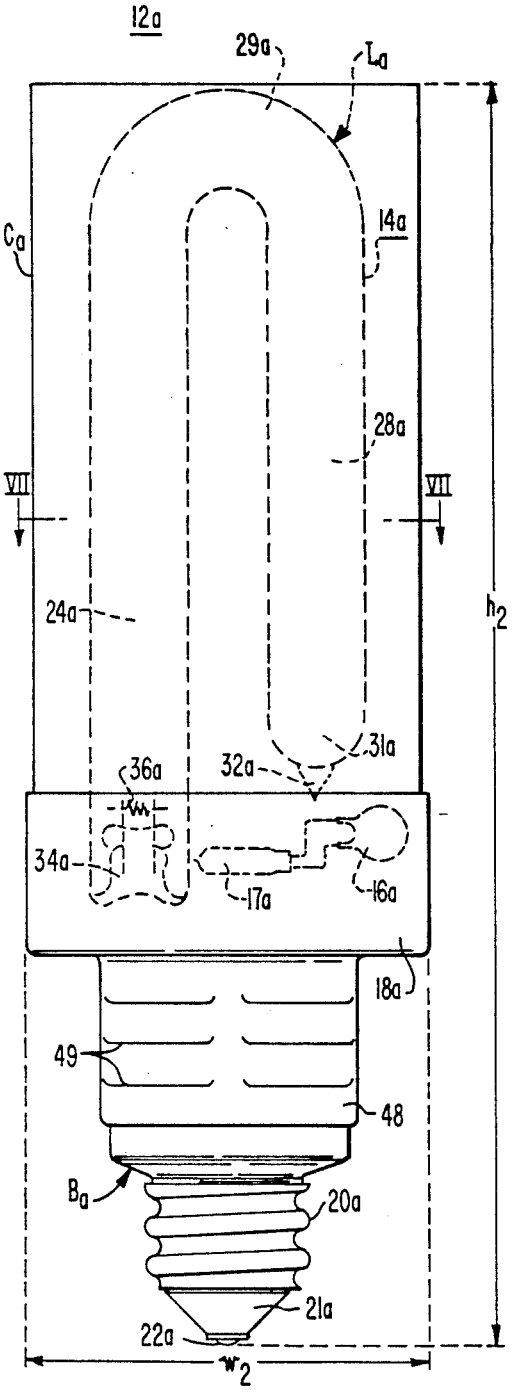
FIG. 5 is a side elevational view of an alternative compact fluorescent lamp unit embodying the invention.
Figure 7:
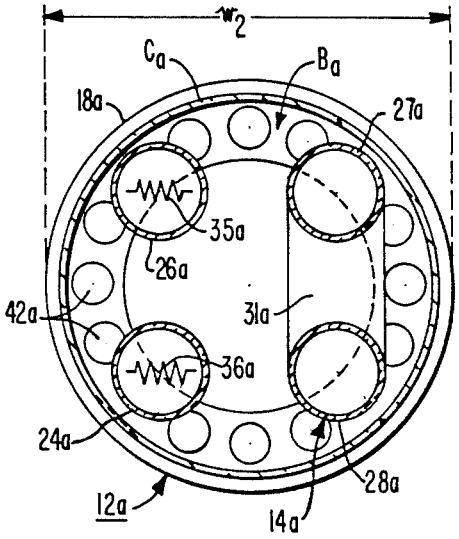
FIG. 7 is a cross-sectional view of the alternative lamp unit, taken along line VII—VII of FIG. 5.
Figure 6:
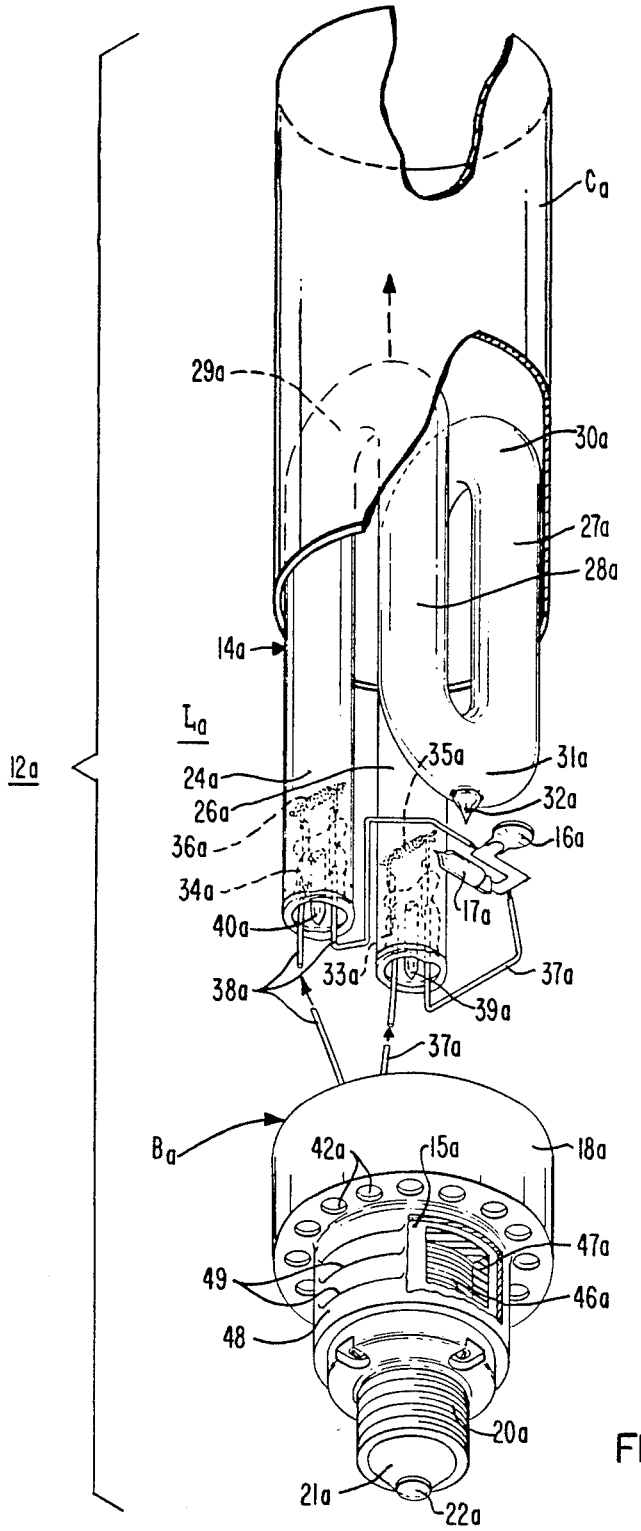
FIG. 6 is an exploded pictorial view of the alternative lamp unit shown in FIG. 5.

An alternative compact lamp unit 12*a*, shown in FIGS. 5–7, employs a ballast component that is "built into" the base structure $B_a$ and thus provides a lamp unit which is slightly longer but smaller in diameter or width dimension than the embodiment just described.

As illustrated in FIGS. 5 and 6, the ballast component 15*a* according to this embodiment is of truncated cylindrical shape rather than elongated slender configuration and is located within a similarly shaped extension 48 that protrudes from the bottom of the cup-shaped portion 18*a* of the base structure $B_a$ and is joined to the threaded base member 2O*a*. The ballast 15*a* is again preferably of the choke type and consists of an iron core (not shown) and a wire winding 47*a* that are encased in a suitable sheath or covering 45*a* of nonconductive material (see FIG. 6). The wall of the cylindrical extension 48 is spaced from the ballast component 15*a* and is provided with a series of laterally extending vent openings 49 which permit air to circulate freely around the ballast component and through the base structure $B_a$ when the lamp unit 12*a* is energized and in use.

As will be noted in FIG. 6, the triple-U-bent fluorescent lamp $L_a$ is identical to that employed in the previous embodiment except that the U-bent segments 29*a*, 3O*a*, 31*a* have a smaller radius of curvature and thus reduce the spacing between the tubular leg segments 24*a*, 26*a*, 27*a*, 28*a*. The condenser 16*a* and starter 17*a* are connected by the insulated lead-in wires 38*a*, 37*a* to the ballast component 15*a* and lamp electrodes 35*a*, 36*a* and the condenser and starter components are disposed within the cup-shaped end 18*a* of the base structure $B_a$ (in the space beneath the medial U-bend 31*a* alongside the sealed legs 24*a*, 26*a* of the envelope 14*a* as in the previous embodiment). The protective cover $C_a$ is modified and consists of a cylindrical sleeve (of translucent or transparent material) that is open at both ends and is seated in and gripped by the circular cup-shaped portion 18*a* of the base structure $B_a$.

As indicated in FIGS. 5 and 7, the placement of the ballast component 15*a* within the base structure $B_a$ increases the overall length $h_2$ of the lamp unit 12*a* but permits a "tighter bundling" of the tubular leg segments of the convoluted envelope 14*a* with a resultant decrease in the width dimension $w_2$ of the lamp unit, compared to the corresponding dimensions of lamp unit 12.

As in the previous embodiment, heat generated by the triple-U-bent fluorescent lamp $L_a$ and the integral circuit components is dissipated by convection cooling produced by the air which circulates through the energized unit 12*a* through the vent openings 42*a* and 49 in the base structure $B_a$ and out of the open end of the tubular protective cover $C_a$. Such convection cooling directs a current of air from outside the lamp unit 12*a* through the base vent apertures 42*a*, 49 into the space occupied by the U-bent envelope segment 31*a* and "cooling" tip segment 32*a* since the latter is located in very close proximity to the apertures 42*a*.

ADDITIONAL ALTERNATIVE LAMP UNIT EMBODIMENT (FIG. 8)

Figure 8:
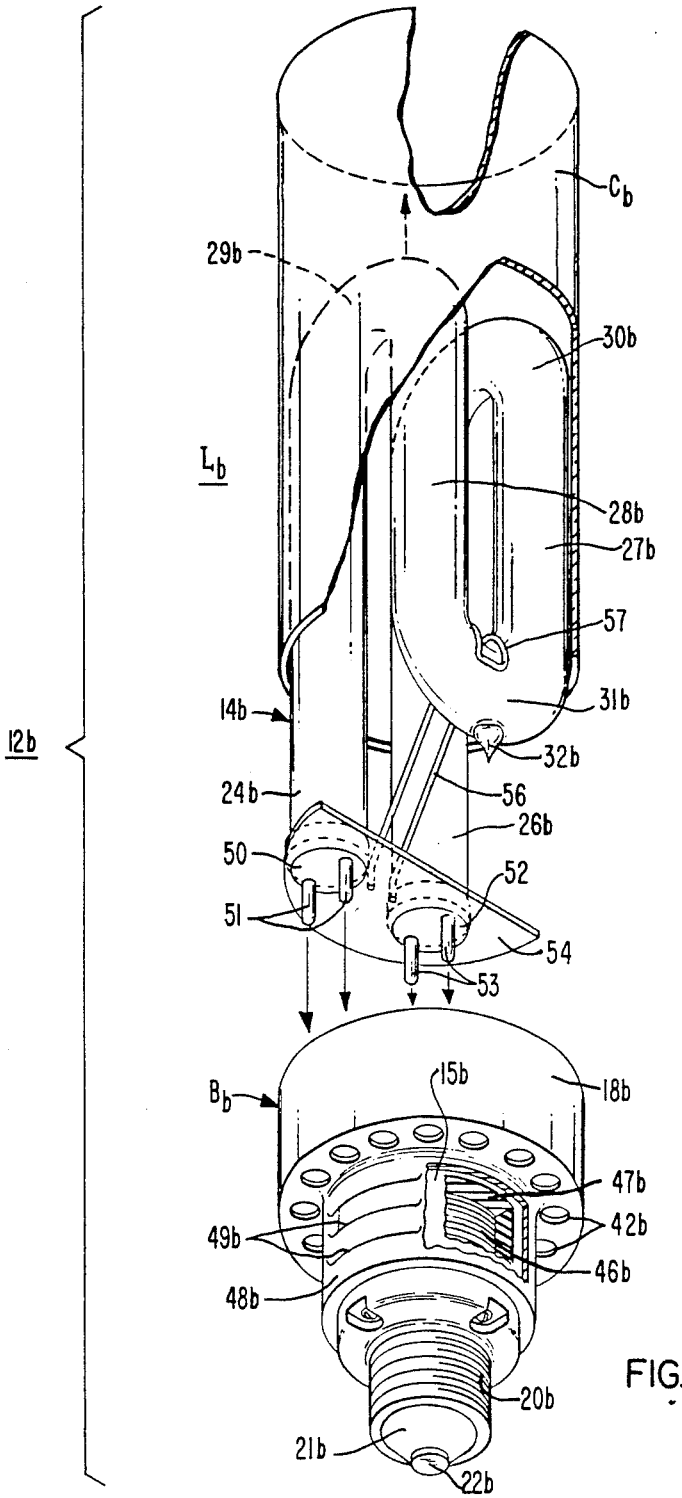
FIG. 8 is an exploded pictorial view of still another embodiment of a compact fluorescent lamp unit according to the invention.

From the standpoint of the consumer, it would be very advantageous financially to be able to remove and replace only the convoluted fluorescent lamp component of the lamp unit and retain the base structure, protective cover and circuit components as permanent parts of the lighting fixture in which the lamp unit is used. A lamp unit 12*b* which provides this cost advantage is shown in FIG. 8 and will now be described.

As will be noted, the fluorescent lamp $L_b$ has the same triple-U-bent type tubular envelope 14*b* as in the previous embodiments except that the sealed ends of the leg segments 24*b* and 26*b* are fitted with small plug-in type base members 50, 52. These base members have protruding contact elements such as rigid pins 51, 53 that are adapted to be inserted into aligned receptacles of a suitable socket member (not shown) located within the cup-shaped portion 18*b* of the base structure $B_b$. The resulting plug-in type electrical connection of the lamp component $L_b$ and the base structure $B_b$ permits the consumer to simply remove the cover $C_b$ and unplug and remove the lamp component (when it becomes inoperable or has reached the end of its useful life) and then plug in a new lamp component. Hence, the lamp unit 12*b* can be readily relamped by the user and the waste and added expense associated with discarding the entire lamp unit each time the fluorescent lamp "burns out" is avoided.

In order to rigidify the lamp envelope 14*b* and permit it to be handled without breaking, the plug-in base members 50 and 52 are desirably secured to a transverse panel member 54 of suitable nonconductive material. In addition, this panel member can be coupled to the medial U-bent segment 31*b* of the envelope by a suitable brace means such as a wire strut 56 that has a hooked end 57 which is slipped over and grips the medial U-bent segment. The panel member 54 is also desirably shaped to nestingly engage the cup-shaped end 18*b* of the base structure $B_b$ and seat against a part thereof in such a manner as to stabilize the fluorescent lamp $L_b$ in its upright assembled position relative to the base structure.

While the sealed ends of the convoluted tubular envelope 14*b* have been provided with pin-type base members, it will be appreciated by those skilled in the art that other kinds of bases and electrical coupling means can be employed which will permit the fluorescent lamp $L_b$ to be easily removed from the lamp unit 12*b* as a separate part by the user and replaced by a new lamp component.

In contrast to the previous embodiments, the starter and condenser components (not shown) are wired to the ballast component 15*b* and the plug-in socket means (also not shown) so that they constitute permanent integral parts of the base structure $B_b$. Alternatively, the starter and condenser could be mounted on top of panel member 54 and connected to the lamp lead-in wires in an appropriate manner so that all three of these connected components comprise a replaceable assembly that can be unplugged from the lamp unit. Of course, if the starter and condenser were connected to the lamp leads in the proper fashion, then only two pin contacts rather than four would be required.

As will also be noted in FIG. 8, the ballast component 15*b* is housed within a cylindrical extension 48*b* of the base structure $B_b$ so that it also constitutes a permanent integral part of the base structure. Vent openings 42*b* and 49*b* in the base structure $B_b$ permit free circulation of air around the ballast component 15*b*, through the cylindrical jacket or cover $C_b$ past the triple-U-bent lamp $L_b$ and its vapor-pressure regulating tip segment 32*b* and then out through the open end of the cover (when the lamp unit 12*b* is burned in a base-down position). The base structure $B_b$ is terminated by a threaded base member 20*b* having exposed contacts so that lamp unit 12*b* is once again of single-ended construction and adapted to be screwed into an incandescent-type lamp socket.

ALTERNATIVE COVER EMBODIMENTS (FIG. 9–11)

Figure 9:
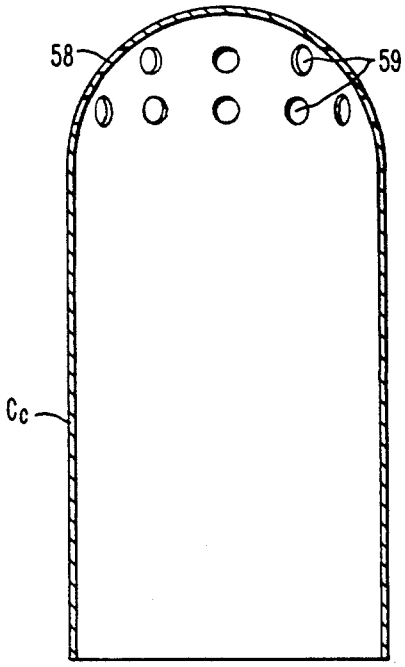
FIGS. 9–11 are longitudinal sectional views of alternative embodiments of protective cover components for the compact lamp units.

The compact discharge lamp units of the present invention can be fitted with various types of protective jackets or covers in addition to those previously described. For example, the light-transmitting cover can be closed at one end by a dome that is provided with suitable vent openings to permit the free passage of air. A cover $C_c$ having these features is illustrated in FIG. 9 and consists of a light-transmitting sleeve of tubular or cylindrical shape that is terminated by a dome 58 having a plurality of circular apertures 5*g* that are distributed in a predetermined spaced pattern.

Figure 10:
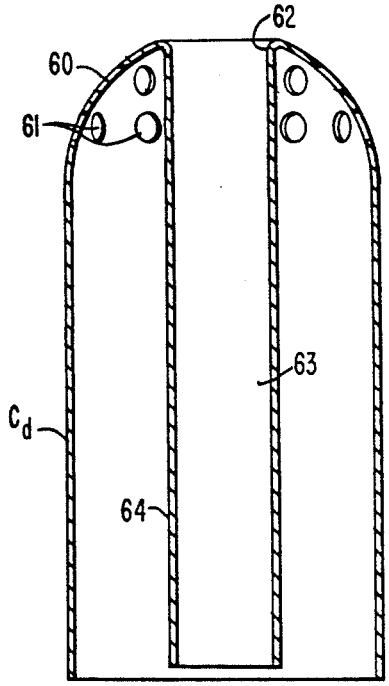

A modified domed-end type protective cover $C_d$ that is specifically designed for a compact lamp unit having an upstanding elongated ballast component disposed in nestled relationship within the legs of a triple-U-bent lamp is shown in FIG. 10. As will be noted, this cover consists of a cylindrical sleeve that is also terminated by a domed end 60 which, in addition to a plurality of spaced apertures 61, also has a central opening 62 that communicates with a longitudinally-extending passageway 63 which is defined by a coaxially disposed tube 64 that is joined to and merges with the domed end 60. The axial passageway 63 is located to accommodate the elongated ballast component of the lamp unit and is dimensioned to fit between the U-bent sections of the triple-U-bent envelope when the cover $C_d$ is secured to the base structure of the lamp unit. The passageway 63 is also slightly larger than the ballast component and thus serves as a "chimney" that enables air to circulate freely through the lamp unit from the vent openings in the base structure, around and along the ballast component and then through the central opening 62 in the domed end 60 of the cover $C_d$. The U-bent sections of the convoluted envelope are disposed in the annular space between the coaxial tube 64 and cylindrical wall of the cover $C_d$ and are thus exposed to air which circulates through this space from the base structure of the lamp unit and through the dome apertures 61.

Figure 11:
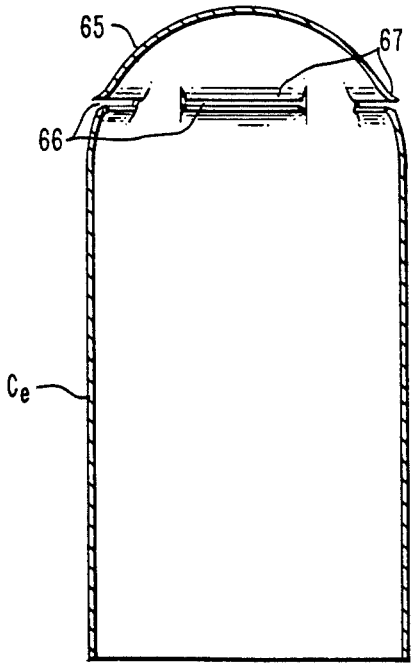

Another form of domed cover $C_e$ is shown in FIG. 11 and consists of a light-transmitting sleeve of tubular or cylindrical configuration having a domed end wall 65 that is provided with a plurality of spaced circumferentially-extending vent openings of slot-like configuration. The overlying portions of the cover $C_d$ are flared outwardly and form louvers 67 that serve as protective shrouds or hoods for the vent openings.

SPECIFIC EXAMPLES

A better appreciation of the compactness and advantageous energy-conserving characteristics of the fluorescent lamp units provided by the present invention will be obtained from the following specific examples of two prototype units that have been made and tested.

A compact fluorescent lamp unit of the type shown in FIGS. 1–4 having a nested "finger" type choke ballast and a medium screw-type base was made by bending a tubular fluorescent lamp 20 inches (50.8 cms.) long and O.69 inch (17.5 mm.) in outside diameter into triple-U-bent configuration so that the overall length of the consulted lamp was approximately $5\frac{1}{2}$ inches (14 cms.) and its width approximately $2\frac{1}{4}$ inches (5.7 cms.). The spacing between the medial U-bent section and sealed end legs of the envelope was about $\frac{7}{8}$ inch (22.2 mm.) and the end legs were spaced about $\frac{1}{2}$ inch (12.7 mm.) apart. An elongated "finger" choke ballast measuring about $\frac{3}{4}'' \times \frac{3}{4}'' \times 4''$ (19 mm. × 19 mm. × 101.6 mm) was inserted in nestled relationship within the three U-bent sections of the fluorescent lamp and connected to the lead wires and a conventional type "glow-lamp" starter and wafer condenser used for standard preheat type fluorescent lamps.

The resulting subassembly was mounted on a 2 13/16 inch diameter (7.14 cms.) support member of the type shown in FIGS. 1 and 3 having $\frac{1}{4}$ inch (6.4 mm.) vent apertures and a medium screw-type base. A protective cover consisting of a frosted glass cylinder approximately $5\frac{1}{2}$ inches (14 cms.) long and $2\frac{3}{4}$ inches (7 cms.) in diameter having a central opening of $1\frac{3}{4}$ inches (4.44 cms.) was slipped over the convoluted fluorescent lamp and seated in the cup-shaped support portion of the base structure.

The completed fluorescent lamp unit had an overall width dimension $w_1$ of 2 13/16 inches (7.14 cms.) and an overall height $h_1$ of about 7 inches (17.8 cms.). The triple-U-bent envelope was coated with "Cool White" halophosphate type phosphor and the lamp unit, when operated at 120 volts input at a current of 345 milliamperes, had an output of 1,000 lumens and a system efficacy (that is, the fluorescent lamp component in combination with the choke ballast) of approximately 37 lumens per watt. The total power consumption of the lamp unit was approximately 27 watts (about 20 watts in the fluorescent lamp component and about 7 watts in the ballast).

A second prototype fluorescent lamp unit made in accordance with the FIGS. 5–7 embodiment contained a triple-U-bent fluorescent lamp which was formed from an envelope 20 mm. in diameter and 43.1 cms. long. The convoluted lamp component had an overall length of 13 cms., a width of 5.1 cms. and the legs of each of the U-bent sections were spaced 11 mm. apart. The lamp was mounted on a base structure having a cylindrical extension that housed a cylindrical choke ballast, the "glow-lamp" starter and the wafer condenser. The base structure had a circular cup-shaped end approximately $2\frac{7}{8}$ inches (7.3 cms.) in diameter and a cylindrical open-ended cover of frosted glass having a diameter of about $2\frac{3}{4}$ inches (7 cms.) and an overall length of $5\frac{1}{2}$ inches (14 cms.) was secured to the base structure. The resulting lamp unit had an overall width dimension $w_2$ of approximately $2\frac{7}{8}$ inches (7.3 cms.) and an overall height dimension $h_2$ of approximately $8\frac{1}{8}$ inches (20.6 cms.). When the lamp unit was operated at 120 volts input and 345 ma, it had a light output of approximately 960 lumens and a system efficacy of 40 lumens per watt.

While life tests on triple-U-bent fluorescent lamps of the type employed in the compact lamp units of the present invention have not been completed, the lamps should have useful lives in the order of 9,000 hours or so since, when mass-produced, they would be made with standard stem and electrode assemblies and utilize the wellknown phosphor coating compositions and other technology used to manufacture conventional fluorescent lamps of equivalent size (15 to 20 watt rating) that have nominal life ratings of such magnitude.

In contrast, a standard 75 watt A19 type incandescent lamp produces about 1,210 lumens at an efficacy of about 16 lumens per watt and has an average life (published) of only 850 hours.

As will be apparent to those skilled in the art, the compact fluorescent lamp units of the present invention can employ triple-U-bent fluorescent lamps made from glass tubing of various diameters and lengths to provide lamp units having higher or lower wattage ratings and light outputs. The starting and/or operating circuits can also be made in the form of solid-state modules or components that are "built into" the base structure or mounted between the legs of the U-bent sections of the envelope to provide a new family of compact low-pressure discharge lamp units that can be advantageously used as cost-saving and energy-conserving replacements for incandescent-type lamps now employed for general lighting applications in homes and offices. The use of solid-state circuit means would be particularly advantageous in fabricating screw-in type lamp units having light outputs of 2,000 lumens or so since the miniaturized circuitry would still make it possible to keep the overall dimensions of such high-output lamp units within the limits required to permit the units to fit into and be used in table lamps and similar lighting fixtures designed for incandescent type lamps.

Of course, if the ballast and other circuit components were physically separated from the fluorescent lamp and made part of a specially-designed lighting fixture (for example, if they were housed within the base of a table lamp or floor lamp), then step-up transformers, high-frequency converters and similar energizing means can be used to increase the efficacy of the system and make the lamp units per se even more compact and economical. In addition, the ballast component can be physically separated from both the discharge lamp unit and the lighting fixture by making the ballast a "pass-through" type that would be connected to and constitute a part of the power cord. Alternatively, such a "pass-through" ballast component could be made in the form of a unit that plugs directly into the wall socket and is connected to the lighting fixture by a power cord.

PREFERRED DRAINAGE AND COOLING TIP CONFIGURATION (FIGS. 12–13)

Figure 12:
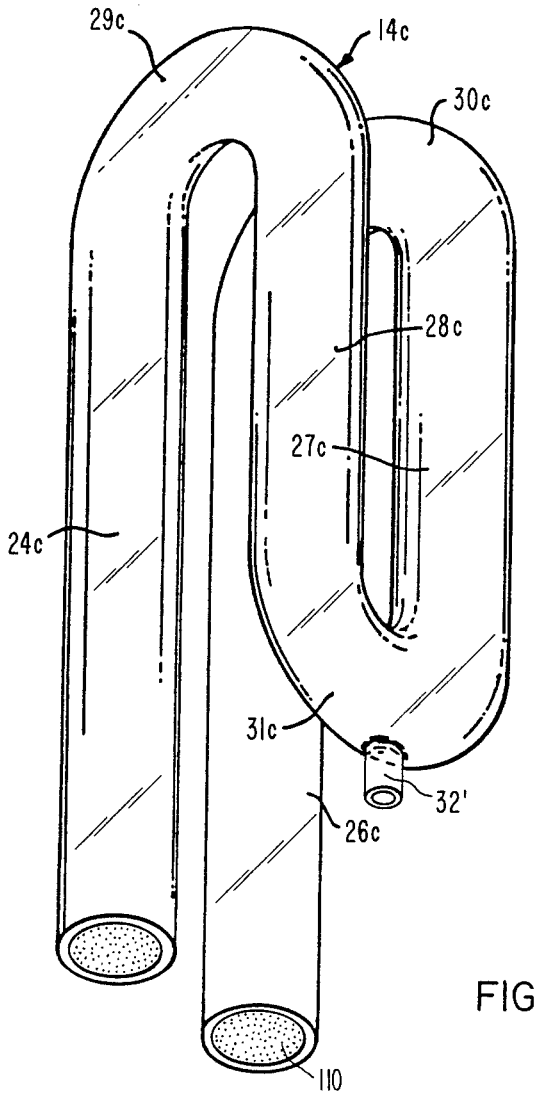
FIG. 12 is a pictorial view of a preferred form of triple-U-bent envelope before its draining and cooling tubulation has been sealed.

A convoluted triple-U-bent envelope **14*c* having a preferred form of open tubulation 32' for allowing the phosphor paint to drain from the envelope during the phosphor-coating operation is shown in FIG. 12. As will be noted, the glass tubulation 32' extends downwardly from the medial U-bent segment 31*c* (when the envelope 14*c* is in upstanding position as shown). This permits the wet paint to drain from the medial U-bent segment 31*c* along with the paint from the other two U-bent segments 29*c*, 30*c*, which flows along the terminal leg segments 24*c*, 26*c* and out of the open ends of the envelope 14*c*. This prevents the wet phosphor paint from collecting at U-bend 31*c* and solves the very difficult problem of depositing a uniform and smooth coating of phosphor 110 on the inner wall surfaces of the convoluted envelope 14*c***.

In the case of a triple-U-bent envelope made of glass tubing having an outer diameter of approximately 18 mm., phosphor coatings of acceptable uniformity were obtained with a drainage tubulation that was about 20 mm. long and had an outside diameter of about 7 mm.

After the phosphor coating dried and was lehred, the glass tubulation 32' was tipped off to form a "cooling" nipple or tip **32*c* that was from about 4 to 10 mm in length and defined a cavity or chamber within the finished lamp for condensed excess mercury. To avoid possible seal problems, the tubulation 32' is preferably wiped clean of phosphor before it is tipped off. The sealed tip 32*c* is accordingly made of clear glass. The rest of the envelope 14*c* inner wall remains coated with the phosphor 110**.

Figure 13:
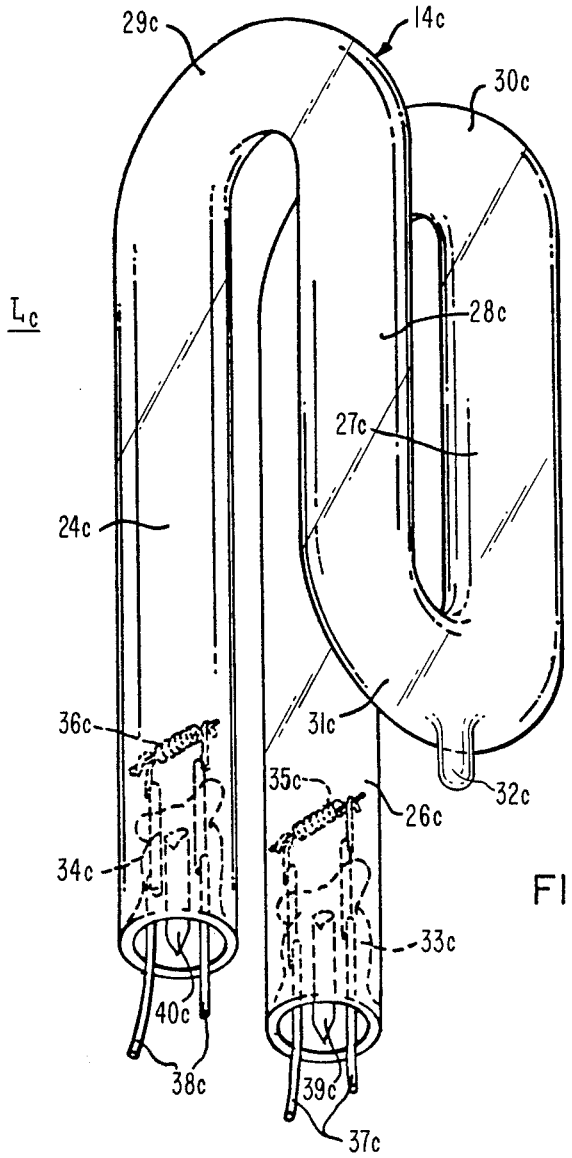
FIG. 13 is a similar view of the aforesaid preferred envelope embodiment after it has been made into a finished fluorescent lamp.

A finished convoluted fluorescent lamp $L_c$ having a triple-U-bent envelope **14*c* with such a cooling tip 32*c* is shown in FIG. 13. Since the tip 32*c* is the coolest part of the lamp when the latter is operating, the excess mercury condenses in the tip-cavity within a few hours and the temperature of the tip 32*c* then controls the mercury-vapor pressure inside the lamp. Maximum lumen output occurs when the tip 32*c*** is at a temperature of about 40° C. Since the bulb wall temperature of a fluorescent lamp of this type made from 18 mm. O.D. tubing operated at about 350 ma is approximately 60° C., the lumen efficacy is much lower without the cooling tip and chamber.

As a specific example of the effectiveness and functional importance of the cooling tubulation in the operation of compact triple-U-bent type fluorescent lamps, two test lamps of such configuration were made at the same time and in the same fashion except that one had a cooling tubulation that was 9 mm: long and around 7 mm. in outside diameter and the other had no such tubulation. After the lamps were burned for 100 hours and stabilized in free air, the lamp with the cooling tubulation (and chamber) produced 22% more lumens than the lamp without the tubulation.

MULTI-U-BENT FLUORESCENT LAMP EMBODIMENTS (FIGS. 14–19)

The dual function drainage-and-cooling tubulation of the present invention is not limited to fluorescent lamps that have triple-U-bent types of envelopes but can be used with the same advantages in other types of compact fluorescent lamps and lamp units.

Figure 14:
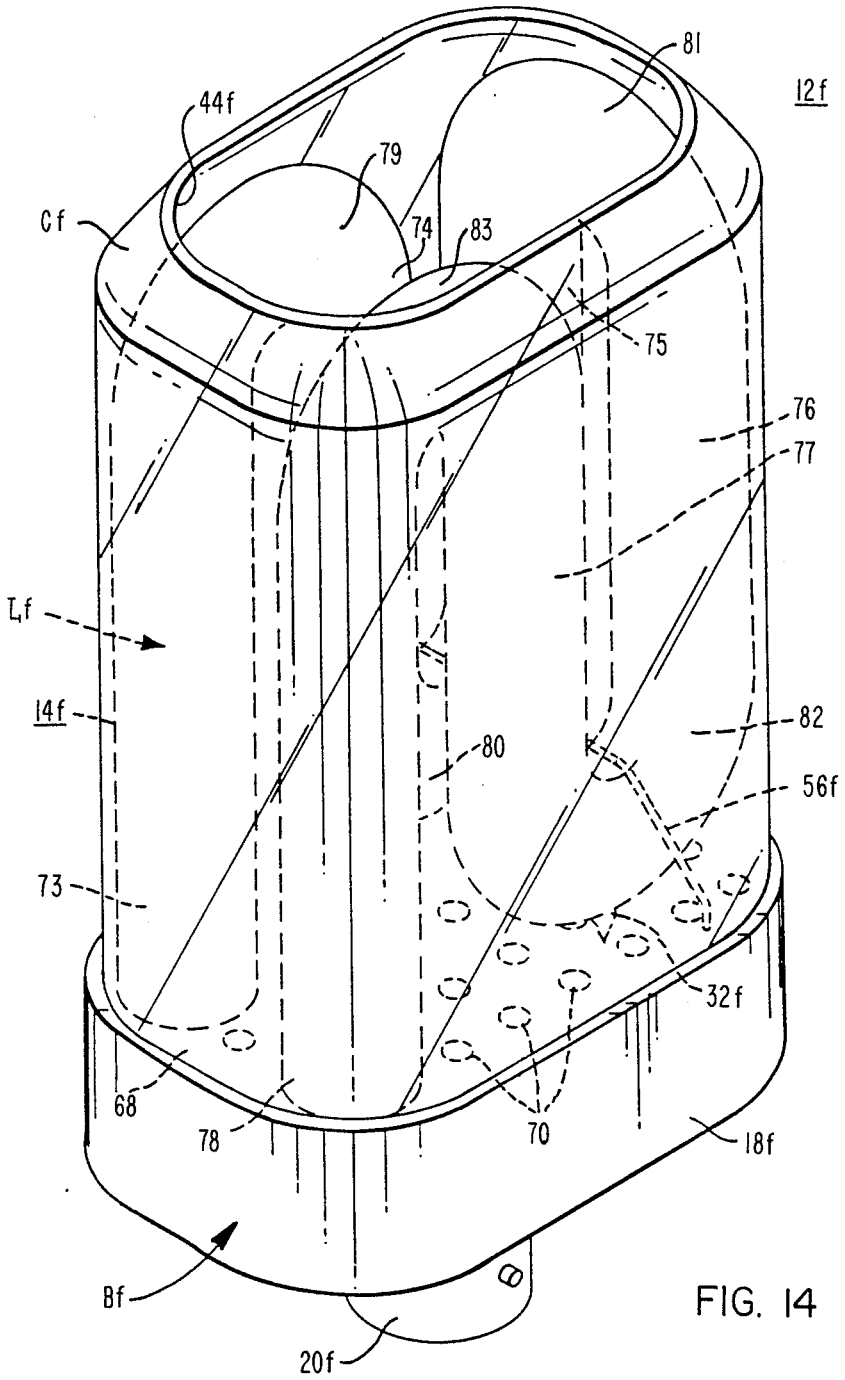
FIG. 14 is a perspective view of another compact lamp unit having a convoluted fluorescent lamp with five U-bent sections.
Figure 15:
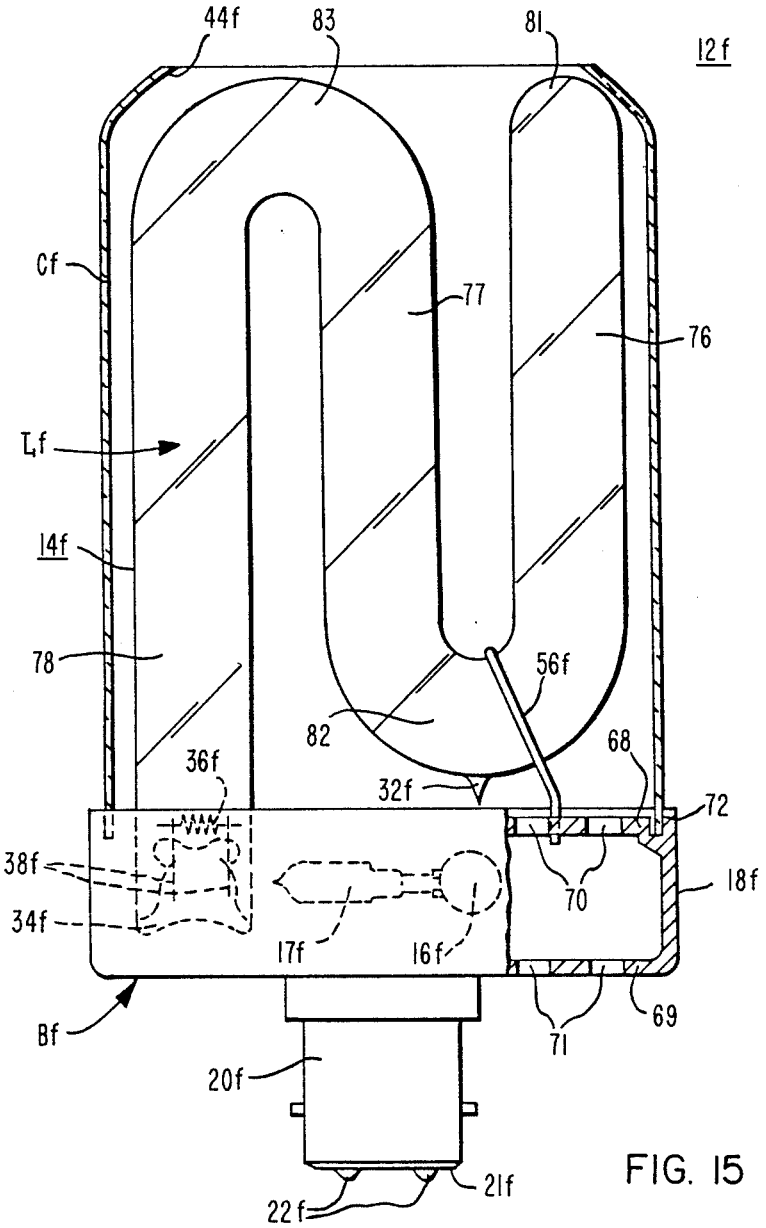
FIG. 15 is a side elevational view, partly in section, of the lamp unit shown in FIG. 14.

In FIGS. 14 and 15 there is shown a compact fluorescent lamp unit **12*f* that contains a multi-U-bent fluorescent lamp Lf which embodies the invention and is held within a light-transmitting housing or cover Cf by a base module or structure Bf. As will be noted, the lamp Lf is of single-ended construction and has a tubular envelope 14*f* of convoluted configuration which provides a concentrated tridimensional light source that has a long arc path and is thus of high efficacy and brightness. The cover Cf has a top opening 44*f* and protectively encloses the lamp. The base structure Bf holds the lamp Lf in assembled relationship with the cover Cf and has a generally rectangular-shaped cup portion 18*f* that accommodates and is coupled to the sealed ends of the lamp envelope 14*f***. It also has an inner wall that extends transversely across the top of the base structure and serves as a panel-support member which retains the lamp Lf in its upright position.

As will be noted more particularly in FIG. 15, the base structure Bf also has a bottom panel or wall 69 and is terminated by a suitable electrical connector component, preferably a bayonet-type base member **20*f* which includes the usual insulator 21*f* and end contacts 22*f*. The walls 68 and 69 of the base structure Bf are provided with a series of spaced apertures 70 and 71, respectively, which permit air to enter the lamp unit 12*f* and pass through the opening 44*f*** at the top of the cover Cf. The "chimney effect" produced by the heat generated by the fluorescent lamp Lf (when the lamp unit is energized) causes air to circulate freely through the unit and convection cool the lamp, thus avoiding excessive operating temperatures and the resultant drop in light output that might occur due to the power loading of the lamp and its compact size.

The cup-shaped portion 18*f* of the base structure Bf can be molded from suitable temperature-resistant plastic to provide a one-piece member that is fastened to the metal shell portion of the bayonet base 20*f*. The rim of the protective cover Cf is seated in a groove 72 (shown in FIG. 15) that is provided along the inner periphery of the cup-shaped portion 18*f* and, in accordance with this embodiment, the chamber which is defined by this part of the base structure Bf contains a conventional condenser 16*f* and starter component 17*f* that are connected to the fluorescent lamp Lf and to a separate ballast component (not shown) in the usual fashion to permit the lamp to be started and operated from an AC power supply.

As illustrated in FIGS. 14 and 15, the envelope 14*f* of the fluorescent lamp Lf comprises a vitreous tube that is bent upon itself in such a manner that it has six substantially straight leg segments 73, 74, 75, 76, 77 and 78 that extend in the same direction and are joined by five U-bent segments 79, 80, 81, 82 and 83. The U-bent segments are of such curvature and so oriented that the tubular legs are disposed in columnar array and spaced from one another. The leg segments and U-bent segments accordingly form five conjoined U-shaped envelope sections that are located in three different planes and define a single discharge channel of serpentine configuration that is terminated by the leg segments 73 and 78. The six straight tubular legs of the envelope 14*f* are disposed in two rows with three legs in each row and, together with the U-bends, form a pair of generally S-shaped sections. The convoluted fluorescent lamp Lf thus constitutes a compact light source that is rectangular in cross section.

As shown in FIGS. 14 and 15, U-bent segment 82 has a tipped-off remnant 32*f* of a glass tubulation that is sealed to the envelope 14*f* after it has been bent into its convoluted form. This tubulation is used to drain phosphor paint from the retrobent envelope during the phosphor-coating operation and thus ensures that the U-bent sections are coated with a uniform layer of phosphor material. Another tipped-off phosphor-draining tubulation (not shown) can be provided on the other downwardly-extending U-bent section 80. Since the compact fluorescent lamp Lf operates at a rather high power loading to attain the desired high brightness, the aforementioned tipped-off tubulations 32*f* afford an additional advantage in the finished lamp since they provide chambers or cavities inside the envelope 14*f* that serve as desirable "cool spots" and reservoirs for condensed mercury which regulate the mercury-vapor pressure during lamp operation.

Since the pressure-regulating tips 32*f* are located near the bottom of the lamp unit 12*f* directly above the vent openings 70, 71 in the base structure Bf (as shown in FIGS. 14 and 15), a stream of cool air flows into the base structure and past the pressure-regulating tips when the unit is operated in a base-down position. This maintains the tips 32*f* and mercury reservoirs in the temperature range required for proper mercury-vapor pressure regulation.

The leg segments 73 and 78 that terminate the envelope 14*f* and the discharge channel are hermetically sealed by conventional stem components which include the usual tungsten-coil electrodes that are coated with suitable electron-emission material and are connected to suitable conductors, such as paired lead-in wires, that extend through the respective stems and beyond the sealed ends of the envelope. The stem 34*f* which seals off leg segment 78 and includes the associated electrode 36*f* and lead-in wires 38*f* is shown in FIG. 15. Each of the stems has a sealed-off exhaust tubulation (not shown) which permits the convoluted envelope 14*f* to be evacuated and then charged with a suitable fill gas and dosed with mercury in accordance with standard lamp-making practice. If desired, non-tubulated type stems can be used and the evacuation, gas-filling and mercury-dosing operations can be done through the phosphor-draining tubulations 32*f* which are fused to and extend from the U-bent segments 80 and 82.

As will be noted in FIGS. 14 and 15, the sealed ends of the terminating leg segments 73, 78 of the convoluted fluorescent lamp Lf are located within the chamber defined by the cup-shaped portion 18*f* of the base structure Bf and are secured in a suitable manner to the top wall 68 of base structure so that the lamp is held in upstanding position within the protective cover Cf. Additional support means such as a wire brace 56*f* can be provided, if desired, to hold the lamp Lf in place. As shown, the brace 56*f* is anchored to the wall 68 of the base structure Bf and extends around and snugly grips the adjacent U-bent segments 80 and 82 of the envelope 14*f*.

The protective cover Cf can be made of glass, heat-resistant plastic or other suitable transparent or translucent material that will not absorb the light rays generated by the fluorescent lamp Lf.

The starter component 17*f* is of the conventional "glow lamp" type and is permanently wired in place and connected in the usual manner to the lamp electrodes. However, the starter could be made in the form of a fuselike component that is mounted within the base structure Bf in such a manner that it may be readily removed and replaced as necessary by a "twist-lock" action. The condenser 16*f* is of the miniature wafer type and is connected in the lamp circuit in such a fashion that it eliminates or minimizes radio interference during lamp starting.

While the convoluted lamp envelope 14*f* can be made by joining five separate U-bent sections of vitreous tubing together, it is preferably formed from a single piece of "soft" lead glass tubing of the kind used for conventional fluorescent lamp bulbs. The glass tubing is bent at the proper locations to form the U-bends and is subsequently coated with phosphor and provided with stem assemblies, evacuated, gas-filled, etc. in the usual manner. A suitable fill gas is argon at a pressure below about 10 Torr, and preferably about 3 Torr. The mercury dosage will vary according to the physical size of the lamp and the power loading at which it is operated but is sufficient to provide mercury vapor at a partial pressure of from about 6 to 10 millitorr, when the lamp Lf is operated at its rated wattage, and maintain the mercury vapor pressure at this level within the lamp during its useful life.

The inner surface of the convoluted tubular envelope 14*f* is coated with a suitable phosphor (or a blend of several phosphors) by flushing it with phosphor paint and draining the paint from the envelope through its open ends and the tubulations 32*f* (before they are tipped-off).

Figure 16:
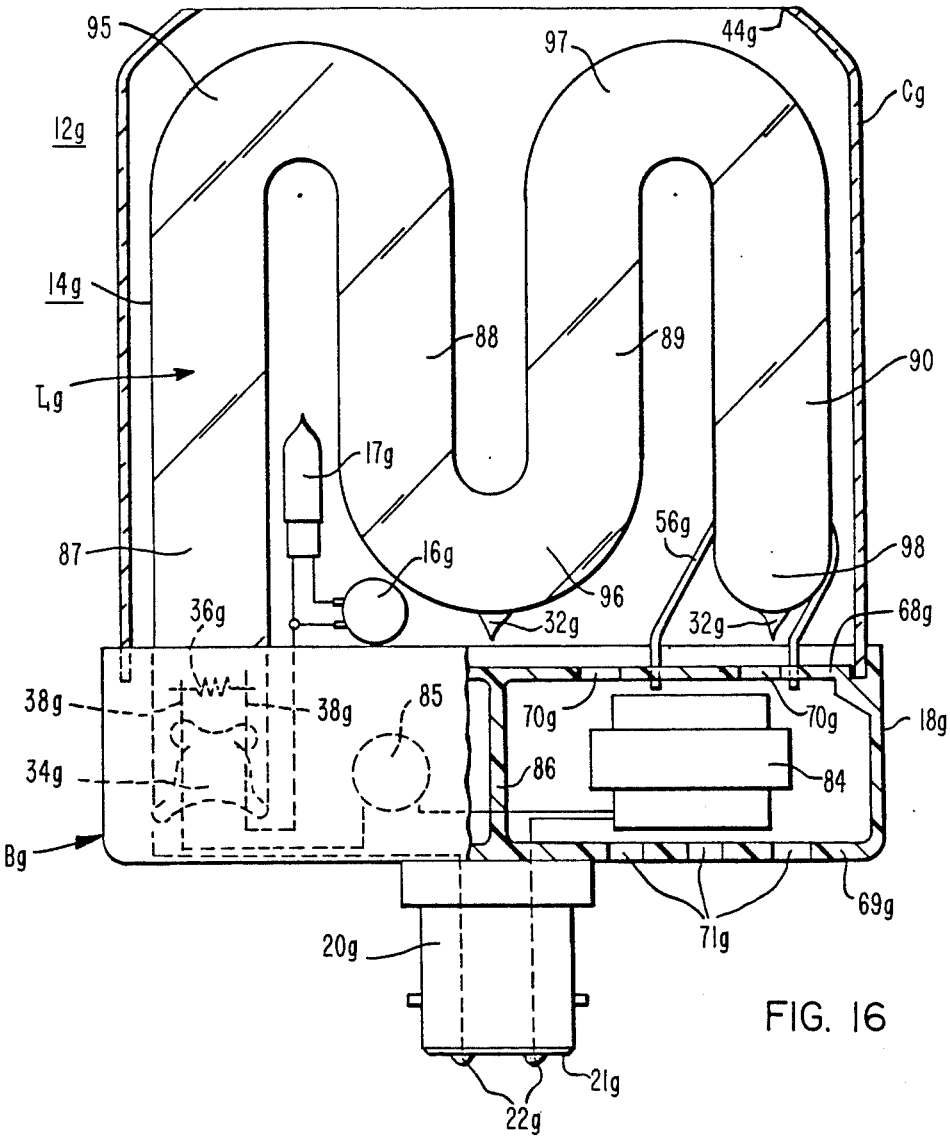
FIG. 16 is a side elevational view, partly in section, of another alternative embodiment of a lamp unit wherein the convoluted fluorescent lamp has seven U-bent sections.

Another type of compact lamp unit 12*g* and convoluted fluorescent lamp Lg which embodies the phosphor drainage and cool-tip feature of the present invention is shown in FIG. 16. As will be noted, the lamp unit 12*g* of the same basic type as those previously described in that it consists of a compact discharge lamp Lg that has a retrobent envelope 14*g* which is disposed within a vented protective cover Cg and held in operative relationship therewith by a base structure Bg which has a cup-shaped portion 18*g* and is terminated by a suitable connector such as a bayonet-typebase 20*g* which includes the usual insulator 21*g* and pair of end contacts 22*g*. In accordance with this embodiment, a ballast means comprising an inductor S4 and a capacitor 85 that are connected in series are located in separate compartments within the base structure Bg which are formed by a partition 86 that constitutes part of the cup-shaped portion 18*g*. The partitioned base structure Bg has a pair of support panels 68*g* and 69*g* that are provided with vent apertures 7O*g*, 71*g* which permit air to circulate freely through the composite base and lamp unit 12*g* and thus provide convection cooling of the enclosed inductor 84 and capacitor 85 as well as the lamp Lg during operation.

Figure 17:
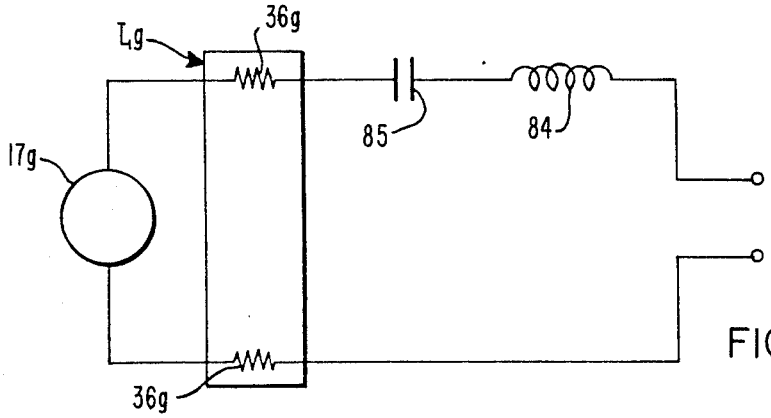
FIG. 17 is a schematic of the L/C type starting and operating circuit used in the lamp units of FIG. 16.

As shown in FIG. 17, the inductor 84 is connected in series with the capacitor 85 and one of the lamp electrodes 36*g*, and the latter is connected to the other electrode 36*g* through the starter component 17*g*. The electrical values of the inductor 84 and capacitor 85 are such that the reactance of the capacitor at the frequency of the AC power supply conventionally used in homes is slightly greater than the reactance of the inductor and thus causes the ballast to operate as a so-called "lead-type" circuit. This generates a voltage across the lamp Lg which is greater than the input or supply voltage and thus reliably starts the lamp despite its long arc length. This type of ballast arrangement is very compact in size, light in weight and has excellent operating efficiency and is thus well suited for use in compact fluorescent lamp units where such characteristics are of prime importance.

As will be noted in FIG. 16, the starter component 17*g* and its connected noise-suppressing capacitor 16*g* can be located within the convolutions of the retrobent lamp envelope 14*g* or, if desired, they can also be housed within the partitioned base module Bg along with the ballast components. As in the previously-described embodiments, auxiliary support means for the retrobent lamp Lg is provided by a brace 56*g* that is anchored to the support wall 68*g* of the base structure and engages the adjacent U-bent section 98 of the envelope 14*g*.

In contrast to the previous embodiments, the convoluted fluorescent lamp Lg has an envelope 14*g* that is of different configuration and has seven conjoined U-shaped sections which provide a discharge channel that is of greater length and thus further increases the light output of the lamp. As shown more clearly in FIG. 18 (which is an isometric view of the lamp envelope 14*g* immediately after it has been formed and before it is phosphor coated and sealed), the convoluted envelope has eight straight tubular leg segments 87, 88, 89, 90, 91, 92, 93 and 94 that are disposed in two rows that each contain four of the leg segments and are joined by seven U-shaped segments 95, 96, 97, 98, 99, 100 and 101. Three of the U-bent segments are conjoined to form a generally M-shaped section that is aligned with and spaced from another generally M-shaped section of the envelope 14*g* which is formed by the second set of three conjoined U-shaped segments. The aforesaid generally M-shaped sections of the envelope are disposed in spaced parallel planes and joined by the seventh U-shaped segment 98 which constitutes the medial portion of the vitreous tube from which the envelope 14i g is formed. The tubular leg segments 87 and 94 which terminate the envelope (and the single discharge channel that is defined by the seven conjoined U-shaped segments) are disposed adjacent one another in a common plane that is spaced from and parallel to the plane which contains the U-shaped segment defined by U-bend 98 and the tubular legs 90 and 91.

As will be noted in FIG. 16, in accordance with the present invention each of the downwardly extending U-bent segments 96, 9 and 100 (not shown) of the lamp envelope 14*g*are provided with protruding tips 32*g* of sealed-off vitreous tubulations which facilitate the phosphor-coating of the convoluted envelope and also provide "cool-spots" for mercury-vapor regulation within the operating fluorescent lamp, as described previously. Once again, the location of the cooling tips or tubulations 32*g* directly above the vent apertures 70*g*, 71*g* in the base module Bg provides a flow of outside air around the tubulations (and out of the open end 44*g* of the cover Cg) which decreases the if operating temperature and helps the tubulations control the mercury-vapor pressure in the desired manner.

Figure 18:
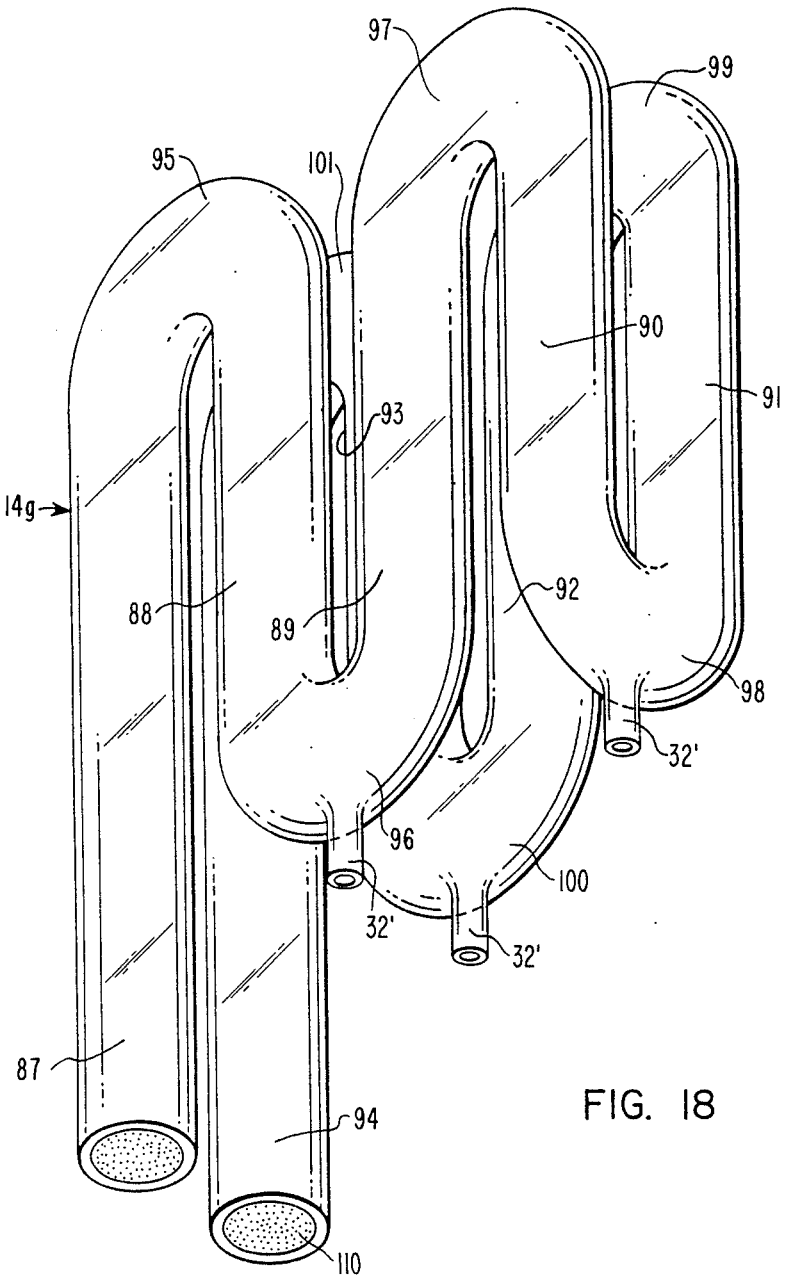
FIG. 18 is a perspective view of a preferred form of convoluted fluorescent lamp envelope that has seven U-bent sections and a draining-cooling tubulation on each of its three downwardly-oriented U-bends.

As shown in FIG. 18, the convoluted envelope 14*g* prior to be processed into a lamp is provided with glass tubulations 32' which are sealed to and extend downwardly from the three U-bends 96, 98 and 100 that are located on the same end of the envelope as the open ends of the terminal leg segments 87 and 94. The open ends of the tubulations 32' and those of the tubing from which the envelope 14*g* is formed are thus all oriented in the same direction and permit the phosphor paint to be poured into the convoluted envelope 14*g* and then drained from the lowermost U-bent segments 96, 98 and 100 in a carefully controlled manner so that a very uniform layer of phosphor 110 is deposited on the inner surfaces of the envelope. The tubulations 32' are of relatively large outside diameter (preferably around 7 mm.) to provide rapid drainage and permit cooling-cavities of sufficient size to be subsequently formed within the finished lamp when the tubulations are tipped off.

Figure 19:
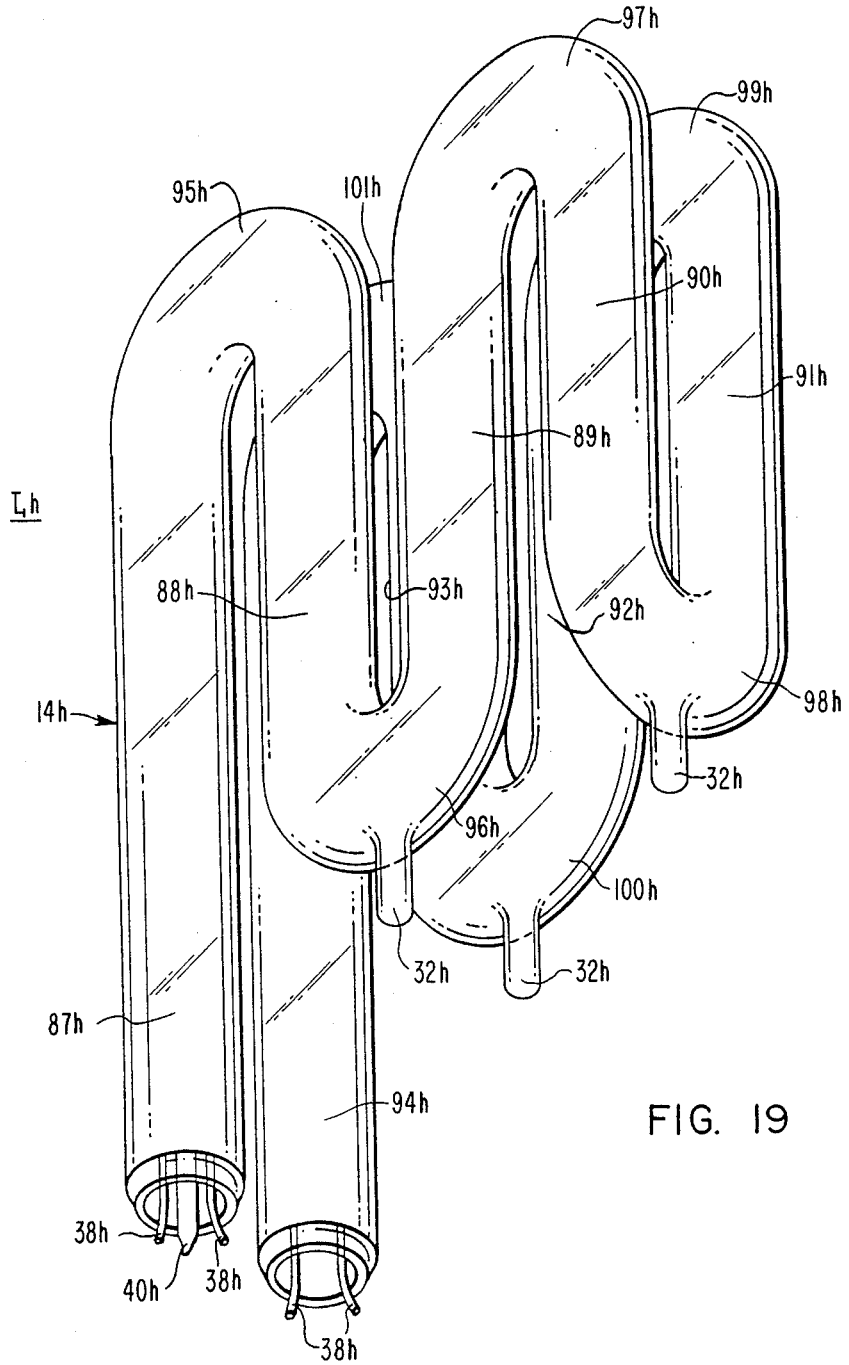
FIG. 19 is a similar view of the aforesaid seven-U-bent envelope after it has been made into a finished fluorescent lamp.

The finished lamp Lh formed from the envelope 14*h* is shown in FIG. 19. As will be noted, the ends of the envelope are sealed by stems (one of which has an exhaust tube 40*h*) and the drainage tubulations are tipped off to provide clear-glass appendages 32*h* of controlled length (preferably from about 4 to 10 mm.) and three "cool" spots or chambers at spaced locations within the lamp.

Figure 20:
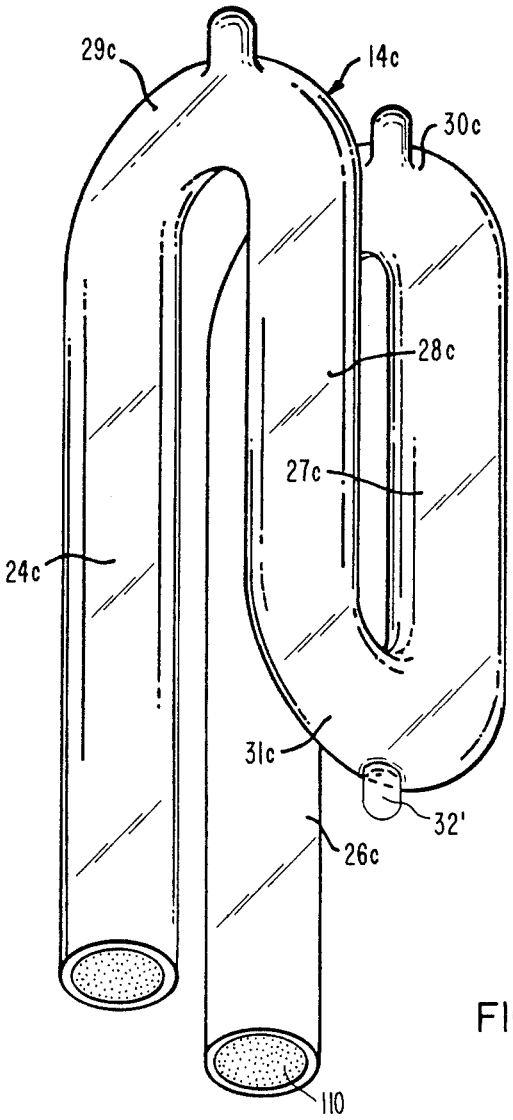
FIG. 20 is a pictorial view of another embodiment of a triple-U-bent lamp envelope.

While the drainage-and-cooling tubulations for each of the illustrated lamp embodiments have been located on U-bent parts of the envelope which are proximate the sealed ends of the envelopes and are thus all positioned directly above the base vents when the lamp units are burned in a base-down position, one or more tipped-off tubulations can also be provided on the U-bends which are located on the opposite end of the envelope as shown in FIG. 20. These tipped-off tubulations will then be positioned adjacent the vent openings in the protective cover and thus be directly exposed to a cool air flow if the lamp unit is operated in a base-up position. This arrangement will thus provide a "universal burning-position" compact fluorescent lamp unit. Of course, the protective cover will be made of such length that the vapor-regulating tubulations will be spaced from and recessed within the cover.

In addition, in those cases where the compact lamp units are operated at such high power inputs and/or under such ambient temperature conditions that the cooling-tubulations operate at too high a temperature to provide proper regulation of the mercury-vapor pressure, it is within the scope of the present invention to also provide an amalgam of mercury and another metal (such as indium, cadmium, etc.) at one or more strategic locations within the fluorescent lamp to assist the cooling tubulations in maintaining the vapor pressure under control. The amalgam can be secured to one or both of the stem assemblies (pursuant to the teachings of U.S. Pat. Nos. 3,534,212 to Evans or 4,020,378 to Morehead, the disclosures of which are incorporated herein by reference). The amalgam can also be placed within one or more of the cooling-tubulations if desired, providing a suitable means such as a porous diaphragm or screen component is used to retain the amalgam at such a location without obstructing the passage of the mercury vapor into and out of the tubulation.

If slow "warm-up" and objectionable delays in reaching rated light output are encountered with convoluted fluorescent lamps that contain such auxiliary amalgam-sources for vapor pressure control, a small quantity of amalgam can be placed close to one of the electrodes (for example, on a suitable carrier which is secured to one of the lead wires pursuant to the teachings of U.S. Pat. No. 3,562,571 to Evans et al). The electrode will rapidly heat this additional amalgam source and thus relieve the "mercury starved" condition of the lamp which is responsible for the retarded stabilization of lamp operation and delayed light output.

We claim as our invention:

1. An electric lamp unit adapted for use in lighting apparatus that requires a compact light source and includes socket means, said lamp unit comprising, in combination;

a fluorescent lamp comprising a sealed tubular envelope of light-transmitting vitreous material and convoluted configuration that contains an ionizable medium and a pair of electrodes and has four substantially straight leg segments that are joined by three U-bent segments and together therewith form three conjoined generally U-shaped sections which define a single serpentine discharge channel, said generally U-shaped sections being disposed in different planes and oriented so that the substantially straight leg segments of the generally U-shaped sections are in tridimensional array and two of said leg segments are disposed adjacent one another and terminate the discharge channel, said electrodes being located within the channel-terminating leg segments of the convoluted tubular envelope and connected to lead-in conductors that extend therefrom, said ionizable medium comprising a predetermined quantity of mercury and a gaseous filling at a pressure below about 10 Torr, a base structure having a threaded base member with a pair of spaced contacts which provides a longitudinally extending screw-in type connector adapted to effect electrical contact with the socket means of said lighting apparatus, said base structure being coupled to the channel-terminating leg segments of the convoluted tubular envelope and together with said envelope constituting a compact unitary assembly, circuit means connected to said lead-in conductors adapted to energize said discharge lamp when the base structure is connected to an electrical power source, and a housing of light-transmitting material supported in enclosing relationship with said discharge lamp by the base structure, said housing and base structure each having at least one vent opening therein which permits air to pass through the lamp unit and dissipate heat that is generated by the fluorescent lamp when the lamp unit is energized and in use, said circuit means being located within the confines of said unitary assembly and connected to the contacts of the base structure so that the resulting lamp unit is of single-ended construction and of such physical size that it is suitable for use in said lighting apparatus and the socket means thereof, one of the said U-bent segments comprising a medial portion of the convoluted envelope and having a protruding sealed tip of vitreous material that defines a cavity within the envelope, said fluorescent lamp being held in upstanding position relative to the base structure and being so oriented relative to the threaded base member that the sealed vitreous tip provides a region within the operating lamp that serves as a reservoir for condensed mercury and thus regulates the mercury-vapor pressure during lamp operation.

2. The electric lamp unit of claim 1 wherein;

the mercury-vapor pressure regulating tubulation on the medial portion on the convoluted envelope is located proximate the channel-terminating leg segments of said envelope and is thus also proximate the base structure, said base structure has a plurality of vent openings therein some of which are disposed below and adjacent the pressure-regulating tubulation when the lamp unit is oriented in a base-down burning position.

3. An electric lamp unit adapted for use in lighting apparatus that requires a light source of compact size, said lamp unit comprising the combination of;

a low-pressure discharge lamp having a sealed tubular envelope of light-transmitting material and convoluted configuration that contains a pair of electrodes and an ionizable medium that includes mercury, said lamp being of the type that requires a regulated mercury-vapor pressure during operation for optimum light output and said convoluted envelope having at least three U-bent segments that are conjoined by substantially straight leg segments and defined a serpentine discharge channel, a base structure coupled to said convoluted discharge lamp and having a vent opening therein, a housing of light-transmitting material disposed in protective enclosing relationship with the discharge lamp and together with said lamp and base structure constituting a compact unitary assembly, said protective housing also having a vent opening therein that is adapted in conjunction with the vent opening in the base structure to permit air to pass through and cool the lamp unit during operation thereof, and means for regulating the mercury-vapor pressure within the discharge lamp comprising a sealed-off tubulation that extends outwardly from one of the U-bent segments of the convoluted envelope and is exposed to the air which passes through the operating lamp unit so that the chamber within the envelope that is defined by said tubulation comprises an air-cooled reservoir for condensed mercury.

4. The compact electric lamp unit of claim 3 wherein each of the U-bent segments of the convoluted lamp envelope has a protruding vapor-pressure regulating tubulation.

5. The compact electric lamp unit of claim 3 wherein said convoluted discharge lamp also contains an amalgam of mercury and another metal that constitutes an auxiliary means for controlling the mercury-vapor pressure within the operating discharge lamp.

6. The compact electric lamp unit of claim 3 wherein;

said low-pressure discharge lamp comprises a fluorescent lamp, and said base structure and protective housing each have a plurality of vent openings therein.

7. The compact fluorescent lamp unit of claim 6 wherein;

the convoluted lamp envelope has three U-bent segments and four leg segments arranged so that the leg segments are disposed in upstanding position relative to the base structure and two of said leg segments terminate the discharge channel and have their free ends located adjacent to and coupled to the base structure, one of the U-bent segments of the convoluted envelope is located proximate the base structure and comprises a medial part of the envelope, and the vapor-pressure regulating tubulation protrudes from the said medial U-bent segment of the convoluted envelope toward the base structure.

8. The compact fluorescent lamp unit of claim 6 wherein;

the convoluted lamp envelope has five U-bent segments and six leg segments arranged so that the leg segments are disposed in upstanding position relative to the base structure and two of the leg segments terminate the discharge channel and have their free ends located adjacent to and coupled to the base structure, two of the U-bent segments of the convoluted envelope are located proximate the base structure and comprise medial portions of the envelope, and each of the said medial U-bent segments of the envelope have a vapor-pressure regulating tubulation that protrudes therefrom toward the vented base structure.

9. The compact fluorescent lamp unit of claim 6 wherein:

the convoluted lamp envelope has seven U-bent segments and eight leg segments arranged so that the leg segments are disposed in upstanding position relative to the base structure and two of said leg segments terminate the discharge channel and have their free ends located adjacent to and coupled to the base structure, three of the U-bent segments of the convoluted envelope are located proximate the base structure and comprise medial portions of the convoluted envelope, and each of the said medial U-bent segments of the envelope has a vapor-pressure regulating tubulation that protrudes therefrom toward the vented base structure.

10. A low-pressure electric discharge lamp adapted for use as a light source in a compact lamp unit and comprising a sealed tubular envelope of light-transmitting material that contains a pair of electrode and an ionizable medium which includes mercury so that the lamp is thus of a type that requires regulated mercury-vapor pressure during operation for optimum light output said envelope being of a convoluted configuration and having at least three U-bent segments that are conjoined by substantially straight leg segments and define a serpentine discharge channel, at least one of said U-bent segments having a sealed-off tubulation protruding outwardly therefrom and defining a cavity within the envelope that serves as a reservoir for condensed mercury within the energized lamp and thus controls the mercury-vapor pressure therein, and the inner surface of said convoluted envelope being coated with a layer of phosphor and the lamp thus comprising a fluorescent lamp, and the mercury-vapor pressure regulating tubulation being about 4 mm. to about 10 mm. in length and comprising the tipped-off remnant of a tubulation that comprises a phosphor drainage component for the envelope during lamp manufacture.

11. The compact electric lamp unit of claim 5 wherein said amalgam is located within the chamber defined by the sealed-off tubulation.

12. The compact electric lamp unit of claim 11 wherein the amalgam is retained within the tubulation chamber by means which blocks the passage of the amalgam but permits the passage of mercury vapor into and out of the tubulation.

13. The compact electric lamp of claim 12 wherein said amalgam-retaining means comprises a porous diaphragm or screen component.

14. The compact electric lamp unit of claim 5 wherein:

said low-pressure discharge lamp comprises a fluorescent lamp the electrodes whereof are mounted on vitreous stems that are sealed to the respective ends of the convoluted envelope, and said amalgam is secured to one or both stems at a predetermined spaced location relative to the associated electrode.

15. The compact electric lamp unit of claim 5 wherein a second amalgam-source is provided within the convoluted lamp envelope and is disposed in such close proximity to one of the electrodes that said second amalgam-source is rapidly heated when the lamp is energized under cold-start conditions and thus supplies the lamp with mercury vapor during the warm-up period of lamp operation before the main source of amalgam has reached operating temperature.

16. In the manufacture of a fluorescent lamp that has a tubular vitreous envelope which has been bent into convoluted configuration and includes a plurality of conjoined U-shaped segments, the method of coating the inner surface of the convoluted envelope with a substantially uniform layer of phosphor and concurrently providing the coated envelope with integral means for regulating the mercury-vapor pressure within the finished lamp, which method comprises;

attaching a tubulation to the curved portion of one of the U-shaped envelope segments in a manner such that the tubulation communicates with the interior of the envelope and extends away from the said curved envelope portion, introducing phosphor paint into the open end of the convoluted envelope and, after the paint has flowed over and been deposited on the inner surface of the envelope, orienting the envelope so that the tubulation faces downwardly and excess phosphor paint drains from the U-shaped segments of the envelope through said tubulation, drying the coating of phosphor paint and lehring the convoluted envelope at a temperature sufficient to convert the paint into the desired coating of phosphor particles, and then, hermetically closing the tip of the tubulation so that the tubulation cavity will provide a cool region within the finished lamp for condensed mercury and thereby serve as an integral regulator means for the mercury-vapor pressure during lamp operation.

17. The method of claim 16 wherein;

said convoluted envelope has more than three U-shaped segments that are so disposed that the U-bends of some of the segments face in a given direction and the U-bends of the remaining segments face in a generally opposite direction, and the U-bends of each of the U-shaped envelope segments are provided with phosphor-draining and vapor-pressure-regulating tubulations.

18. The method of claim 16 wherein the phosphor-coated convoluted envelope is evacuated, filled with a starting gas, and dosed with mercury after the ends of the envelope have been sealed to vitreous stems and closed.

19. The method of claim 16 wherein;

said convoluted envelope has three conjoined U-shaped segments that are arranged so that two of the segments are disposed in substantially aligned relationship and are joined by the third segment which thus comprises the medial portion of the envelope and has its U-bend positioned adjacent to and facing in the same general direction as the open ends of the envelope, and said tubulation is attached to the U-bend of the said third U-shaped envelope segment and thus permits excess phosphor paint to drain from the convoluted envelope through the open ends of the envelope as well as through the tubulation.

20. The method of claim 19 wherein said tubulation is composed of vitreous material and is sealed to the envelope.

21. The method of claim 20 wherein the vitreous tubulation is hermetically closed by heat-sealing the tip thereof.

22. The method of claim 21 wherein the phosphor coating is removed from the vitreous tubulation before the tip-sealing operation.

* * * * *